US009101031B2

(12) United States Patent
Tanaka

(10) Patent No.: US 9,101,031 B2
(45) Date of Patent: Aug. 4, 2015

(54) LIGHTING DEVICE, AND HEADLIGHT LIGHTING DEVICE, HEADLIGHT, AND VEHICLE USING SAME

(75) Inventor: Tosifumi Tanaka, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 57 days.

(21) Appl. No.: 13/505,846

(22) PCT Filed: Nov. 1, 2010

(86) PCT No.: PCT/IB2010/002771

§ 371 (c)(1),
(2), (4) Date: May 3, 2012

(87) PCT Pub. No.: WO2011/055200

PCT Pub. Date: May 12, 2011

(65) Prior Publication Data

US 2012/0217873 A1 Aug. 30, 2012

(30) Foreign Application Priority Data

Nov. 6, 2009 (JP) ..... 2009-255370

(51) Int. Cl.
*G05F 1/00* (2006.01)
*H05B 33/08* (2006.01)

(52) U.S. Cl.
CPC ..... *H05B 33/0887* (2013.01); *H05B 33/089* (2013.01); *H05B 33/0815* (2013.01)

(58) Field of Classification Search
CPC ..... G05F 1/00
USPC ..... 315/82, 77, 308, 291, 224
See application file for complete search history.

(56) References Cited

U.S. PATENT DOCUMENTS 4,213,075 A * 7/1980 Ericson ..... 315/83
5,241,242 A * 8/1993 Daub ..... 315/82
6,007,210 A * 12/1999 Yamamoto et al. ..... 362/459

(Continued)

FOREIGN PATENT DOCUMENTS

CN 1456029 A 11/2003
JP 2003249383 A 9/2003

(Continued)

OTHER PUBLICATIONS

Japanese Office Action dated Dec. 24, 2013 and English summary thereof.

(Continued)

*Primary Examiner* — Douglas W Owens
*Assistant Examiner* — Wei Chan
(74) *Attorney, Agent, or Firm* — Bacon & Thomas, PLLC

(57) ABSTRACT

A lighting device includes a DC/DC converter for receiving DC power and converting the DC power into a predetermined output required for a load; a voltage detection unit for detecting an output voltage or an equivalent value from the output voltage; a current detection unit for detecting an output current or an equivalent value from the output current; and a control unit for controlling the DC/DC converter based on detection values from the voltage detection unit and/or the current detection unit. The control unit reduces the output when a rapid change is detected in a load state in which a change in the output within a first predetermined time is equal to or greater than a predetermined width.

16 Claims, 30 Drawing Sheets

(56) References Cited

U.S. PATENT DOCUMENTS

| | | | | |
|---|---|---|---|---|
| 6,049,179 | A * | 4/2000 | Kisaichi et al. | 315/307 |
| 6,411,045 | B1 * | 6/2002 | Nerone | 315/291 |
| 6,693,393 | B2 * | 2/2004 | Konishi et al. | 315/224 |
| 7,002,305 | B2 * | 2/2006 | Kambara et al. | 315/291 |
| 7,282,872 | B2 * | 10/2007 | Ohta et al. | 315/308 |
| 2003/0111969 | A1 * | 6/2003 | Konishi et al. | 315/291 |
| 2003/0160703 | A1 | 8/2003 | Kurose | |
| 2004/0251852 | A1 * | 12/2004 | Kambara et al. | 315/291 |
| 2005/0062435 | A1 * | 3/2005 | Namba et al. | 315/224 |
| 2007/0018591 | A1 * | 1/2007 | Noguchi et al. | 315/308 |
| 2008/0192211 | A1 * | 8/2008 | Kitagawa | 353/85 |
| 2010/0052538 | A1 * | 3/2010 | Tanaka et al. | 315/82 |
| 2010/0225235 | A1 | 9/2010 | Nagase | |
| 2011/0062869 | A1 * | 3/2011 | Hsu et al. | 315/77 |
| 2011/0193481 | A1 * | 8/2011 | Nakamura | 315/82 |

FOREIGN PATENT DOCUMENTS

| | | | |
|---|---|---|---|
| JP | 2004-119164 | A | 4/2004 |
| JP | 200685993 | A | 3/2006 |
| JP | 2006114279 | | 4/2006 |
| JP | 2006172819 | | 6/2006 |
| JP | 2006210836 | A | 8/2006 |
| JP | 2008210607 | A | 9/2008 |
| JP | 2009111035 | A | 5/2009 |

OTHER PUBLICATIONS

Chinese Office Action dated Nov. 8, 2013 and English summary thereof.

The International Search Report for PCT/IB2010/002771, Mar. 8, 2011.

* cited by examiner

LIGHTING DEVICE, AND HEADLIGHT LIGHTING DEVICE, HEADLIGHT, AND VEHICLE USING SAME

FIELD OF THE INVENTION

The present invention relates to controlling a lighting device for a light source such as an LED or a discharge lamp in a fault of a load of the lighting device.

BACKGROUND OF THE INVENTION

Recently, a luminous efficiency of an LED has been enhanced and lighting apparatuses using an LED have been mass-produced. In particular, in the past, the trend in the sector of vehicle headlights has employed HID lamps instead of halogen lamps in order to enhance visibility (to enhance brightness). However, with the improvement of the luminous efficiency of the LED, vehicles employing LED headlights are being mass-produced.

FIG. 23 shows a configuration of a conventional vehicle LED lighting device. A DC voltage from a power source E1 that is supplied by interworking with a LOW beam switch is stepped up and down as a voltage for lighting a load by a DC/DC converter 1. A DC voltage as an output voltage from the DC/DC converter 1 is applied to a semiconductor light source 5 to light the semiconductor light source 5. This lighting device lights the semiconductor light source 5 by controlling a constant current, and a control unit 10 is used to perform the control.

A load voltage and a load current of the semiconductor light source 5 are detected by resistors R1 to R3 and inputted to the control unit 10 through a voltage detection circuit 3 and a current detection circuit 4. The control unit 10 averages the load voltage and the load current through averaging units 11 and 12. A comparison calculation unit 15 compares an average current value Ia and a current command value outputted from a ROM in a controller 16 and calculates/outputs a primary side current command value Ic such that the average current value Ia and the current command value become equal. By comparing the primary side current command value Ic and a primary side current detection value Id by a comparator CP, a switching element Q1 of the DC/DC converter 1 is driven.

The switching element Q1 of the DC/DC converter 1 is ON/OFF driven by an output from a flipflop FF as a drive circuit. When the flipflop FF is set by a high frequency ON signal HF, the switching element Q1 is turned on and a gradually increasing current flows through a primary coil of a transformer T1, whereby energy is accumulated in the transformer T1. When the switching element Q1 is an FET, ON resistance thereof is nearly ohmic-resistance, so the primary side current detection value Id can be detected by amplifying a drain voltage by a primary side current detection circuit 2 configured as an OP amplifier or the like. When the primary side current detection value Id reaches the primary side current command value Ic, the output of the comparator CP is inverted and the flipflop FF is reset to turn off the switching element Q1. When the switching element Q1 is turned off, counter electromotive force is generated from a secondary coil due to the accumulated energy in the transformer T1 and the capacitor C1 is charged through a diode D1.

Through the foregoing circuit configuration, the constant current control is performed by PWM-controlling the ON time of the switching element Q1 of the DC/DC converter 1.

In addition to the constant current control, the controller 16 detects an abnormal power or load based on the detection results of the power detection circuit 7, the voltage detection circuit 3 or the current detection circuit 4, and, accordingly, stops the operation of the DC/DC converter 1 and outputs a fault signal.

Further, the control unit 10 is powered by a control power generation unit 6, and a power to the control power generation unit 6 is supplied from the LOW beam switch power source E1. The averaging unit 13 reads and averages power source voltages.

A control flow of the control unit 10 for performing the constant current regulation of the semiconductor light source 5 and determining a fault is shown in FIG. 24. The control unit 10 performs the constant current regulation of the semiconductor light source 5 in steps #04 to #12 and determines a fault of a power and a load in steps #13 to #17. Each step of FIG. 24 will be described hereinafter.

In step #01, a power source is turned on and a reset is released. A reset input is not shown in FIG. 23.

In step #02, the control unit 10 initializes a variable, a flag or the like used in operating.

In step #03, the control unit 10 determines whether or not the LOW beam switch is in an ON state based on an input from the power detection circuit 7. For example, as explained hereinafter, when the power source voltage, which is averaged after being A/D converted and detected by the power detection circuit 7, is greater than 9 V and smaller than 16 V (i.e., 9 V<power source voltage<16 V), the LOW beam switch is determined to be in an ON state. When the LOW beam switch is not determined to be an ON state, a loop of lighting the semiconductor light source 5 after step #04 is not performed.

In step #04, the power source voltage detected through the A/D conversion in the power detection circuit 7 is read out.

In step #05, the averaging unit 13 adds the lately stored detection values to the detection value inputted from the power detection circuit 7 to average the power source voltages. As an example of the averaging, three latest detection values are stored (updated when read out), and when the next value is read, the next value is added to the stored three latest detection values and then the result is divided by four.

In step #06, the voltage detection circuit 3 reads out a load voltage detected through the A/D conversion.

In step #07, the averaging unit 11 adds the previously stored load voltage values to the detected load voltage to thereby obtain an average voltage value Va through the same way as described in step #05.

In step #08, the comparison calculation unit 15 reads out an output current command value from the ROM of the controller 16.

In step #09, the output current detected through A/D conversion at the current detection circuit 4 is inputted to the averaging unit 12.

In step #10, the averaging unit 12 adds the detected output current to the previously stored output current values and an average current value Ia is obtained, as the same way described in step #05.

In step #11, the comparison calculation unit 15 compares the output current command value with the average current value Ia.

In step #12, the comparison calculation unit 15 changes the primary side current command value Ic based on the comparison result.

In step #13, the controller 16 determines whether or not the power source voltage inputted through the averaging unit 13 is normal by checking whether or not the power source voltage is within a predetermined voltage range (from a normal power lower limit to a normal power upper limit). Herein, a range, e.g., from 6 V to 20 V is a normal range. When the power source voltage is abnormal, an operation stop processing (step #15) is performed and the process returns to the LOW beam switch ON determination (step #03).

In step #14, the controller 16 determines whether or not the load voltage inputted through the averaging unit 11 is normal by checking whether or not the load voltage is within a predetermined voltage (from a normal output voltage lower limit to a normal output voltage upper limit). Herein, a range, e.g., from 10 V to 40 V is a normal range. When the load voltage is determined to be normal, the process returns to step #04, and when the load voltage is determined to be abnormal, a load fault signal is outputted (step #16) and permanent stop processing (step #17) is performed.

In step #15, the controller 16 executes operation stop processing (stops the DC/DC converter and clears data within the control unit).

In step #16, the controller 16 outputs a load fault signal in order to inform about the load fault. Specifically, the control unit 10 may inform the fault by outputting a HIGH/LOW signal or by using a communications function or the like.

In step #17, the controller 16 executes permanent stop processing by running an infinite loop of operation stop processing.

Through this control, when the LED as a load has an open/short failure, the fault can be detected by determining whether or not an output voltage is higher than the normal output voltage upper limit and, accordingly, the operation can be stopped.

Patent Document 1 (Japanese Patent Application Publication No. 2006-114279) discloses a technique of reducing an output current value when an output voltage is higher than a normal output voltage upper limit, without having to stop an operation. Further, Patent Document 2 (Japanese Patent Application Publication No. 2006-172819) discloses a technique of reducing an output by using an external interrupt processing to speed up fault detection when a microcomputer is used in controlling.

FIG. 25 shows waveforms of an output voltage and an output current when an output open fault (a situation in which an output power of the lighting device is not provided to a load by a certain reason) occurs. In the related art example, the operation is stopped when an output voltage exceeds a predetermined voltage. For example, regardless whether a load voltage of a connected semiconductor light source is large or not (the load voltage being determined by a forward voltage Vf), the operation is stopped when the output voltage of the lighting device is increased up to a normal output voltage upper limit, which is an upper limit of a load voltage normal range.

However, when an output open fault is generated by a loose contact of bonding of an LED chip or an output connector, it may happen that the contact to the load is open only for an instant and then immediately re-connected (referred to as load chattering hereinafter).

FIG. 26 shows waveforms of an output voltage and an output current when the load chattering occurs. When a semiconductor light source having a high forward voltage Vf is connected, the output voltage is increased up to the normal output voltage upper limit during the load chattering, thereby stopping the operation. And when the load is connected again, the operation starts again. It may be also possible to configure the lighting device not to start the operation after the load is re-connected. However, when a semiconductor light source having a low forward voltage Vf is connected, the output voltage does not reach the normal output voltage upper limit during the load chattering. And when the load is connected again, a voltage much higher than the normal forward voltage Vf is applied to the semiconductor light source, and the output current is stabilized after an over-current flows. The excessive current applies a great load to the semiconductor light source and the lighting device, which, in a worst-case, may lead to inflicting damage on the semiconductor light source or the lighting device.

In addition, when a load is entirely or partially shorted, when the power source voltage is instantly increased, or the like, the output current increases rapidly in a moment, which damages the semiconductor light source or the lighting device. In the foregoing Patent Document 2, a response is quickly made by using an interrupt to a microcomputer or the like. However, since the output voltage or the output current is not increased up to the normal output voltage upper limit or lowered down to the normal output current upper limit, it may not stop the operation. As a result, the semiconductor light source or the lighting device may be damaged.

SUMMARY OF THE INVENTION

In view of the above, the present invention provides a lighting device capable of quickly detecting a fault in a power, a load, or a connection state, regardless of a load voltage, to thereby reduce an output, and a headlight lighting device, a headlight and a vehicle using the same.

In accordance with a first aspect of the present invention, there is provided a lighting device, which includes a DC/DC converter for receiving a DC power and converting the DC power into a predetermined output required for a load; a voltage detection unit for detecting an output voltage or a corresponding value to the output voltage; a current detection unit for detecting an output current or a corresponding value to the output current; and a control unit for controlling the DC/DC converter based on detection values from the voltage detection unit and/or the current detection unit, wherein when a rapid change is detected in a load state in which a change of the output is equal to or greater than a predetermined width within a first predetermined time, the control unit reduces the output.

In accordance with the above configuration, when a rapid change in a load state in which a change in an output during a certain period of time is greater than a certain width is detected, an output is reduced, thereby realizing a stable lighting device in which a fault of power, a load, or a connection state can be quickly detected without relying on a state of a load voltage to reduce an output, and a stress is not provided to a light source or a lighting device.

In this aspect, preferably, the load is a semiconductor light source, and the control unit controls the DC/DC converter such that the output current becomes a first predetermined current value.

In this aspect, preferably, the rapid change in the load state in which the change in the output is equal to or greater than the predetermined width is a change in the output voltage which is equal to or greater than 5 V per 100 μs.

Alternatively, the rapid change in the load state in which the change in the output is equal to or greater than the predetermined width is a change in the output current which is equal to or greater than 0.12 A per 300 μs.

Alternatively, when a current greater than a second predetermined current value that is greater than the first predetermined current value continues for a second predetermined time, the control unit controls the DC/DC converter to be stopped, and the rapid change in the load state in which the change in the output is equal to or greater than the predetermined width is that a third predetermined current value greater than the second predetermined current value flows.

In this aspect, preferably, the control unit controls the DC/DC converter in a boundary current mode, and the reduction in the output may be changing the mode into a discontinuous current mode while maintaining an ON state of a switching device of the DC/DC converter.

Alternatively, the reduction in the output may be stopping the DC/DC converter.

Alternatively, the reduction in the output may be intermittently operating the DC/DC converter.

Alternatively, the reduction in the output may be changing from controlling the output current to be the first predetermined current value into controlling the output voltage to be a predetermined voltage value.

In this aspect, preferably, the predetermined voltage value may be a voltage value before the output is changed.

In this aspect, preferably, when the output current, after a third predetermined time since the reduction of the output, is equal to or greater than a predetermined determination threshold value, the control unit may stop the reduction of the output.

In this aspect, preferably, the predetermined determination threshold value may be set to be smaller than a current value just before a rapid increase in a load voltage and/or a rapid decrease in a load current is detected.

In this aspect, preferably, the third predetermined time is less than 20 ms.

In accordance with a second aspect of the present invention, there is provided a headlight lighting device comprising the lighting device of the first aspect, and lighting a headlight of a vehicle.

In accordance with a third aspect of the present invention, there is provided a headlight comprising the lighting device of the first aspect, or the headlight lighting device of the second aspect.

In accordance with a fourth aspect of the present invention, there is provided a vehicle comprising the lighting device of the first aspect, the headlight lighting device of the second aspect, or the headlight of the third aspect.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
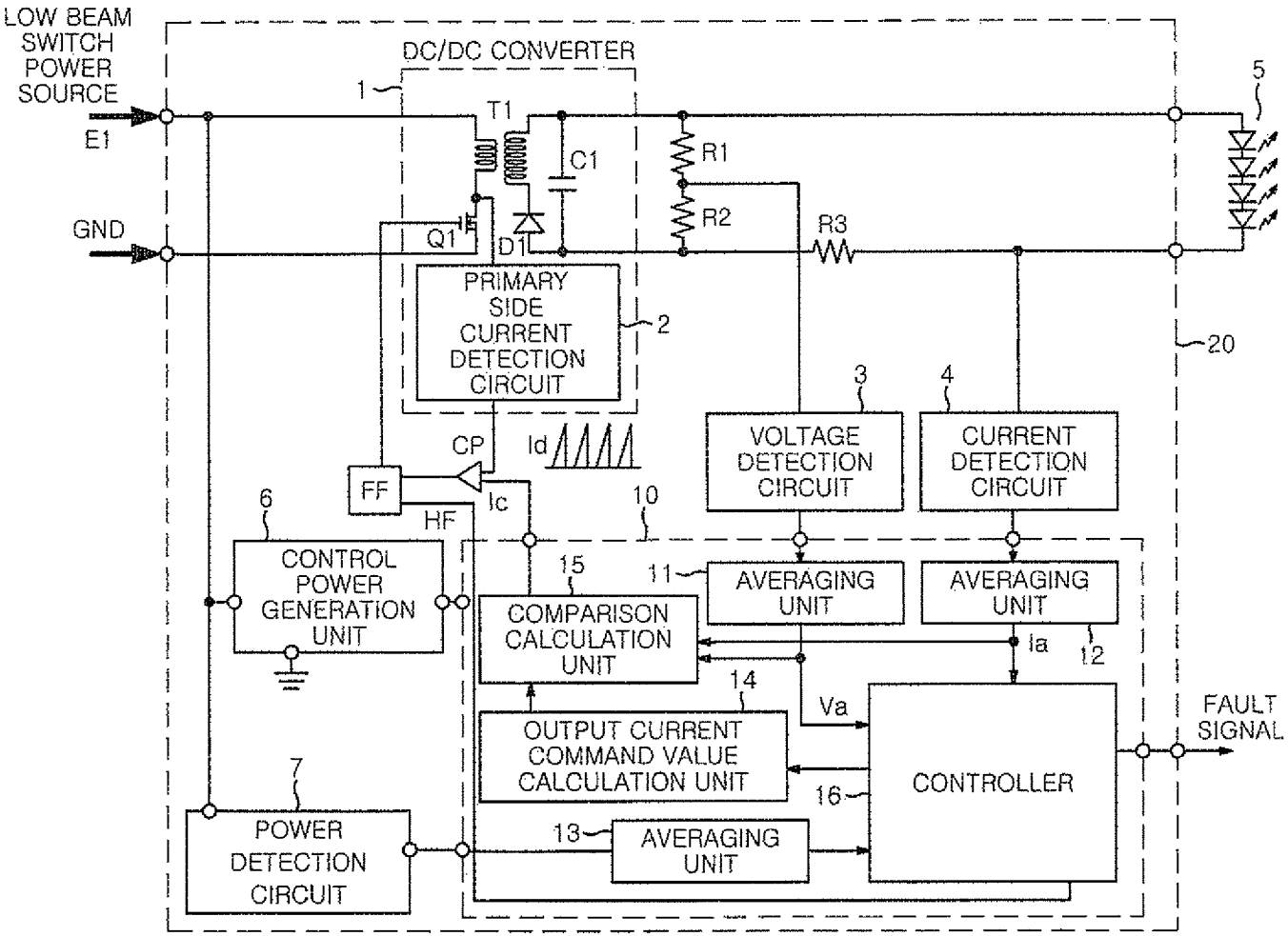
FIG. 1 is a circuit diagram of a lighting device in accordance with an embodiment of the present invention.

The embodiments of the present invention will be described with reference to the accompanying drawings which form a part hereof. In the drawings, same reference numerals are used for the same or like parts and a repeated description thereof will be omitted.

First Embodiment

Figure 23:
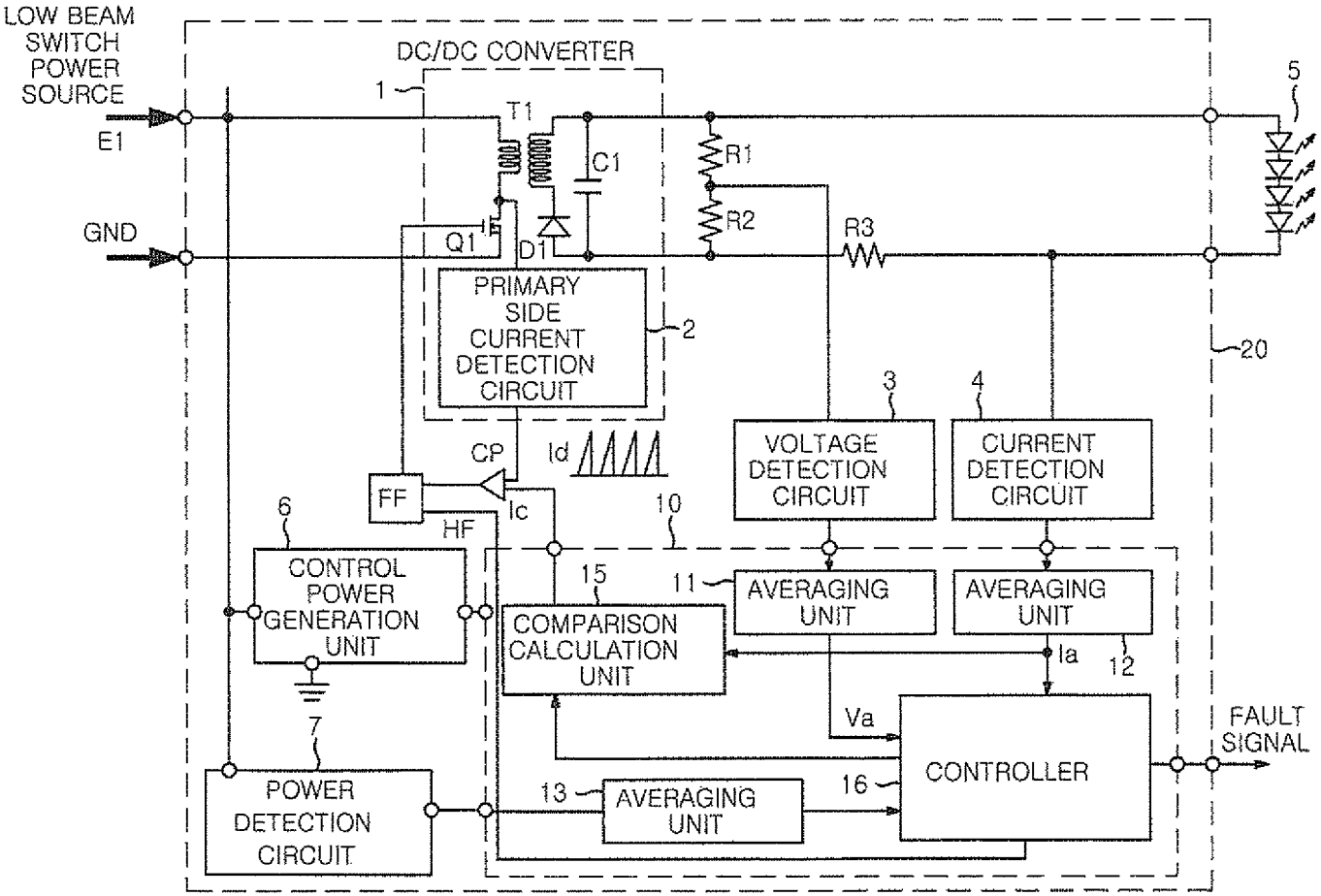
FIG. 23 (PRIOR ART)
FIG. 23 is a circuit diagram of a related art example.
Figure 24:
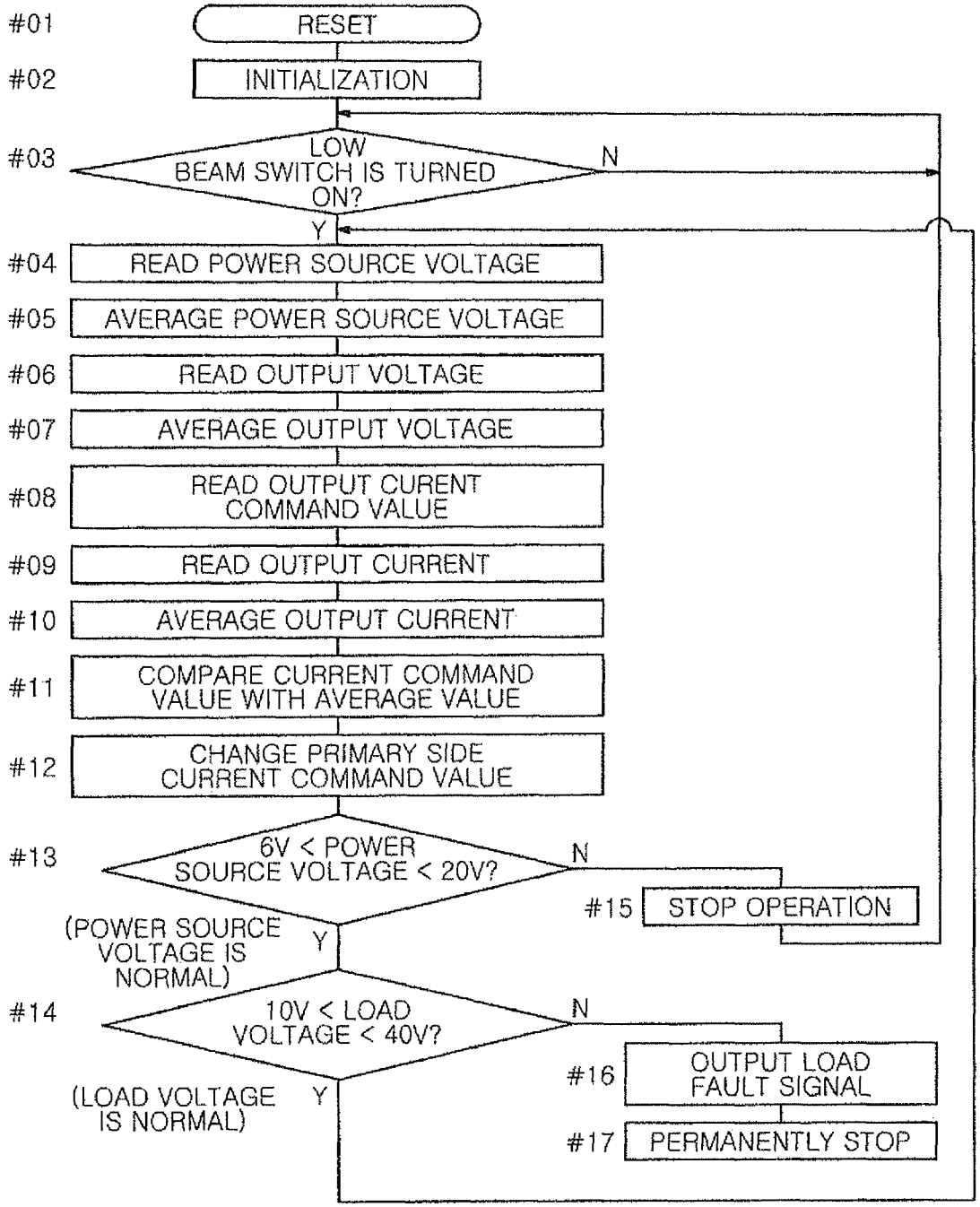
FIG. 24 (PRIOR ART)
FIG. 24 is a flow chart illustrating an operation of the related art example.
Figure 25:
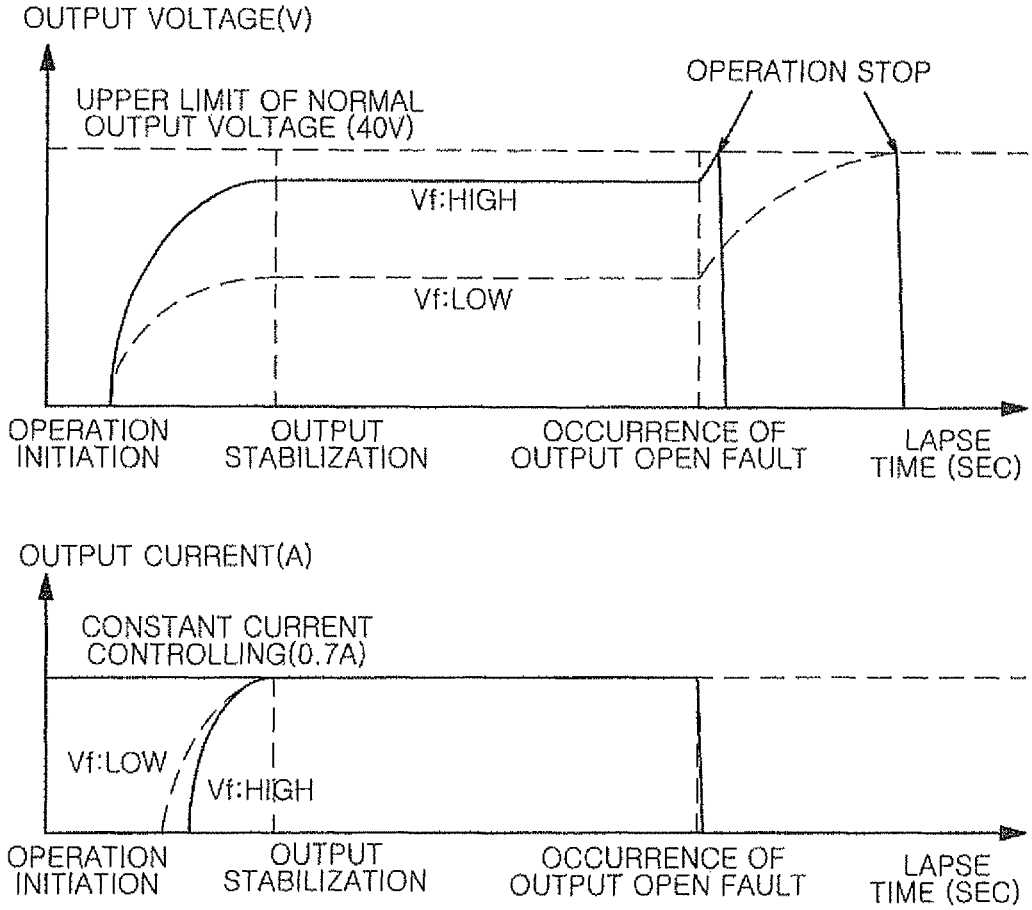
FIG. 25 (PRIOR ART)
FIG. 25 is a view showing operational waveforms when a load is open in accordance with the related art example.
Figure 26:
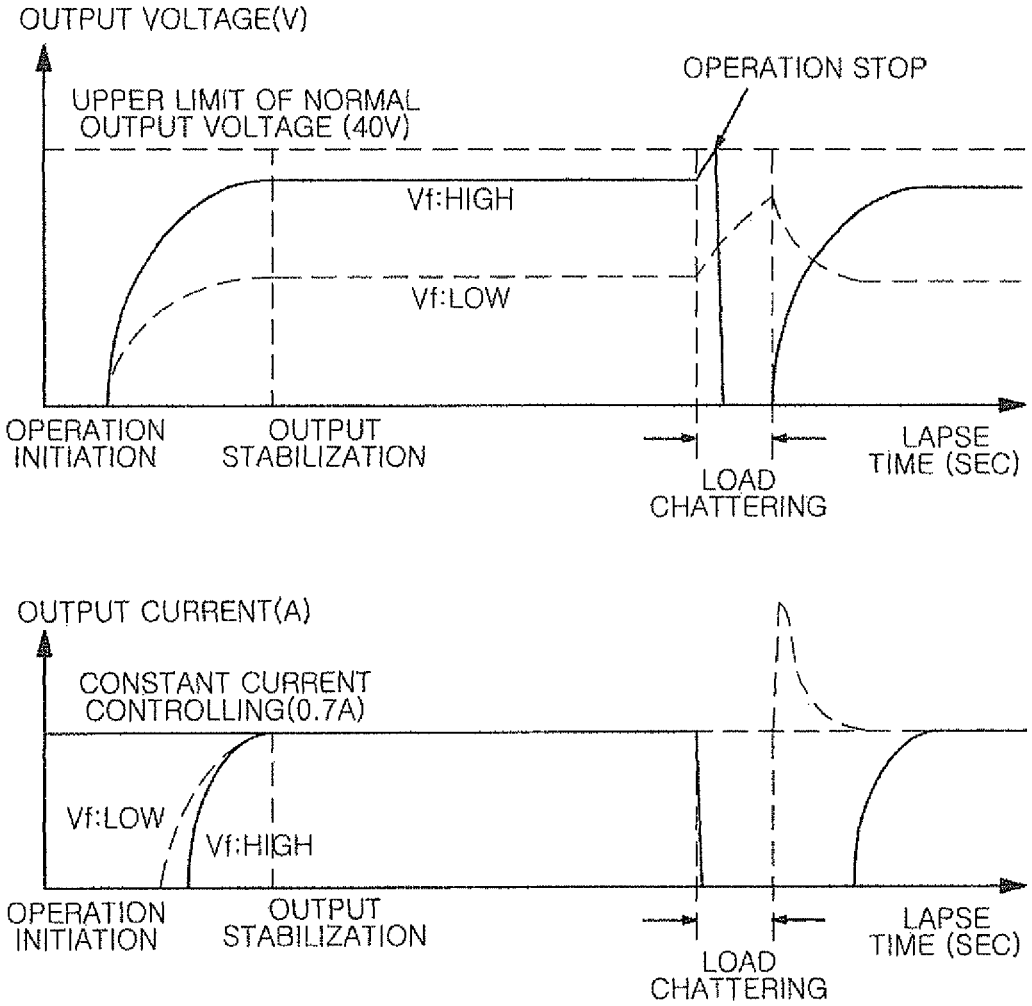
FIG. 26 (PRIOR ART)
FIG. 26 is a view showing operational waveforms when a load has a fault in accordance with the related art example.

As shown in FIG. 1, a configuration of a lighting device in accordance with an embodiment of the present invention is the same as that of the related art example (FIG. 23) except for the configuration and contents of the control unit 10. Further, in control flows, the same reference numerals are used for the same steps as those of the related art example (FIG. 24), and so a description thereof in the present embodiment will be omitted.

Figure 2:
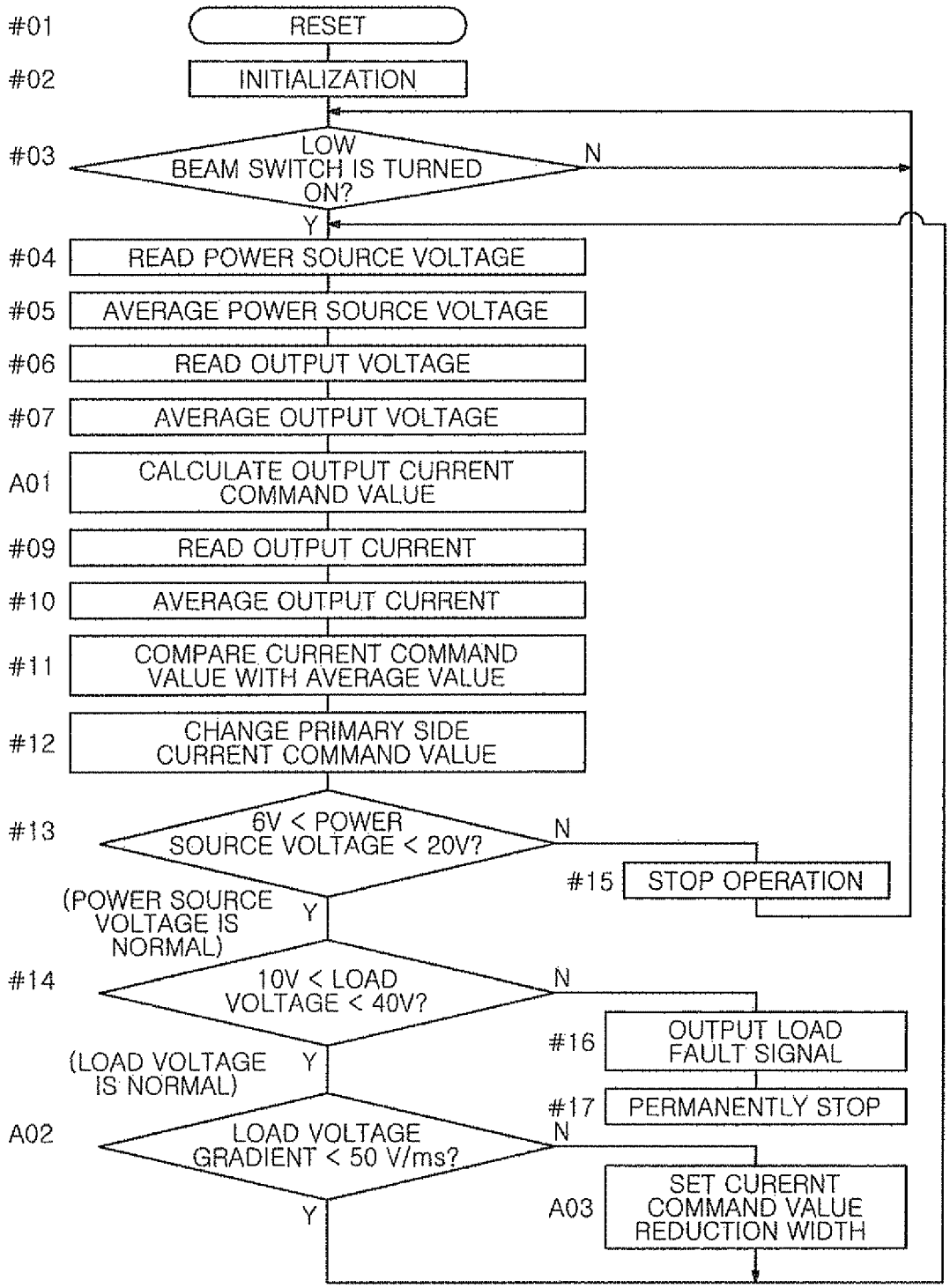
FIG. 2 is a flow chart illustrating an operation in accordance with a first embodiment of the present invention.

FIG. 2 shows a control flow of the control unit 10 in accordance with a first embodiment of the present invention. In the related art example, the output current command value is read out and the DC/DC converter 1 is controlled to allow the average current Ia to converge to the output current command value in step #08. However, in the present embodiment, a gradient of a load voltage is detected. When the gradient of the load voltage is, e.g., equal to or higher than 50 V/ms, a control flow for reducing the output current command value is added. Hereinafter, the changed flow for realizing such control will be described in detail.

Further, in the related art example, the output current command value stored in the ROM of the controller is read out in step #08. However, in the present embodiment, in step A01, the output current command value is read out from the ROM by an output current command value calculation unit 14, and then, the output current command value is set by subtracting a current command value reduction width set in step A03 (to be described later).

In step A02, the controller 16 stores the past output voltages in advance and calculates a gradient of the output voltage. When the gradient of the output voltage is equal to or greater than 50 V/ms, the process proceeds to the step A03 in which the current command value reduction width is set.

In step A03, the controller 16 sets the current command value reduction width.

Figure 3:
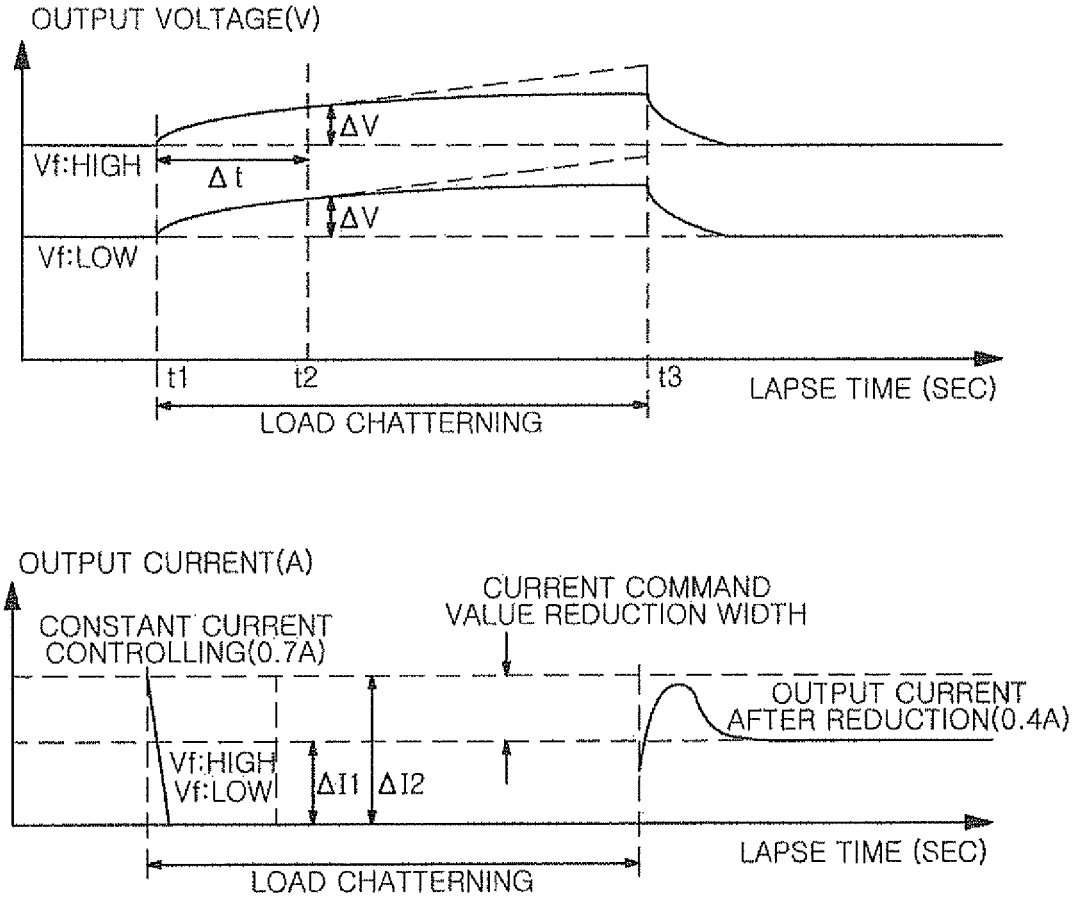
FIG. 3 is a view showing operational waveforms in the occurrence of a load fault in the first embodiment of the present invention.

FIG. 3 shows waveforms of an output voltage and current in load chattering in the present embodiment. In FIG. 3, respective states of outputs in cases where a forward voltage Vf is great and small due to a deviation of a forward voltage Vf are shown. At a time t1, load chattering (load open) occurs and an output current is lowered to zero. Accordingly, an output voltage increases, and, for example, a voltage change of ΔV (5 V) at a time t2 after Δt (100 μs) is detected (ΔV/Δt≥50 V/ms).

Due to the detection of the voltage change, the output current command value is changed from, e.g., 0.7 A (ΔI2) to 0.4 A (ΔI1) (see FIG. 3). A primary side current command value is changed by comparing a current command value and an actual current value. So when the output current command value is lowered, a variation (increase width) of the primary side current command value is also reduced. Thus, with present embodiment, as compared to the output voltage of the related art example indicated by a dotted line, the output voltage can be suppressed as indicated by a solid line. Accordingly, load chattering is resolved at a time t3, and when a semiconductor light source is connected, an inrush current can be suppressed because an increase in the output voltage is suppressed, thereby preventing the semiconductor light source and the lighting device from being damaged. In the present embodiment, since the output current command value is reduced, the inrush current (overshoot of the output current), which may occur when the load chattering is resolved, can be further reduced.

If the lighting continues while the output current is reduced, a dimming state with a low luminous flux continues. When such dimming state continues, e.g., in a headlight, traveling safety of a vehicle may be affected. For this reason, obviously, the dimming state needs to be returned to the original state after the lapse of a certain period of time. Further, while a load open state continues until the dimming state is returned to the original state (not load chattering), preferably, the operation is required to be stopped by using additional determination means (e.g., when the load voltage exceeds the normal output voltage upper limit 40 V, when the output current value is lower than the normal output current lower limit 0.2 A, or the like).

In the present embodiment, an observation time of Δt (100 μs) is set to prevent malfunction such that the output is not reduced over an instantaneous change in voltage.

In the present embodiment, whether or not the current command value starts to reduce is determined by the gradient of the output voltage, but it may also be determined by the gradient of the output current. For example, by determining whether or not a gradient of an output current is equal to or lower than −50 A/ms, it is possible to detect that the current is almost zero after 100 μs. Further, a determination result of the gradient of the output voltage and that of the gradient of the output current may be obtained and AND-operated to achieve the same effect. Furthermore, by AND-operating the results, obviously, an unnecessary initiation of reducing an output can be prevented.

Figure 4A:
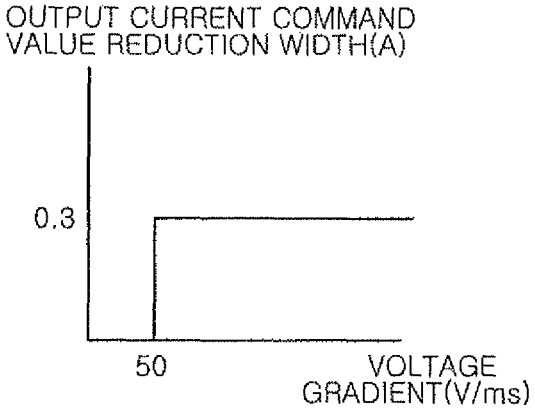
FIGS. 4A to 4C are views illustrating an operation of the first embodiment of the present invention.
Figure 4B:
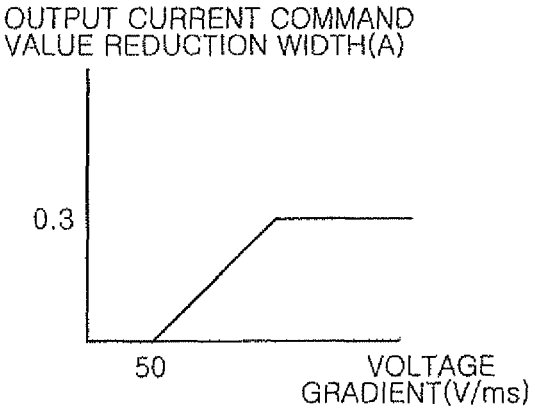
Figure 4C:
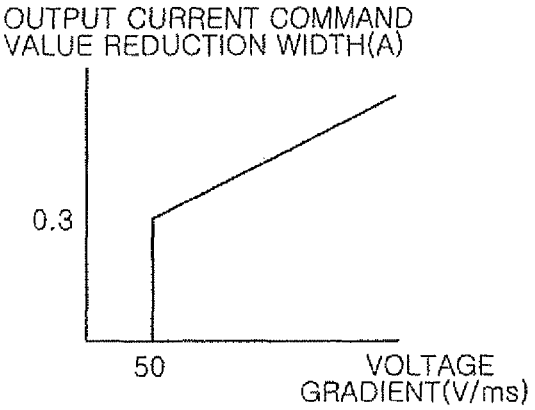

In addition, as shown in FIG. 4A, a reduction width of the current command value can be made as a constant, or as shown in FIGS. 4B and 4C, by increasing the reduction width of the current command value as the gradient of the output voltage (or output current) becomes greater, the effect of preventing damage on the semiconductor light source or the lighting device and the effect of preventing flickering due to the reduction in an output can be balanced.

Figure 5:
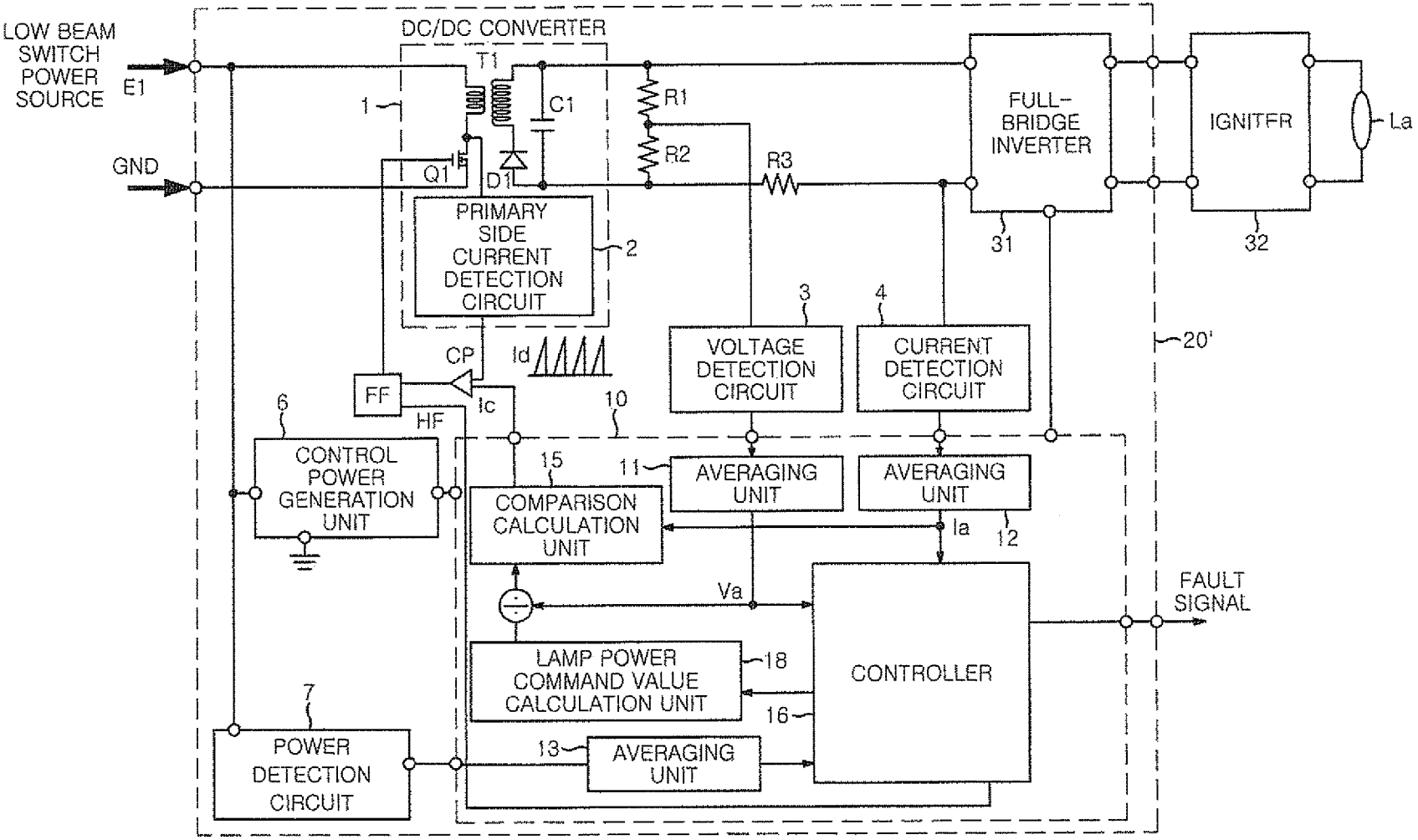
FIG. 5 is a circuit diagram in accordance with a modification of the first embodiment of the present invention.

Further, in the present embodiment, the load is described as the semiconductor light source 5, but, even with a high luminance discharge lamp La as shown in FIG. 5, the same effect can be obtained by reducing a command value of output power. The reason is because, as the deviation of the output voltage is greater, more effect of the present invention can be significant.

Although not shown in detail, the discharge lamp lighting device additionally includes a full-bridge inverter 31 for realizing square wave lighting and an igniter 32 for generating a high voltage pulse for starting the high luminance discharge lamp La. Further, in order to execute constant power control, a lamp current target value is calculated by dividing a lamp power command value from a lamp power command value calculation unit 18 in the control unit 10 by an average voltage value Va, an output current command value Ic is calculated by obtaining a difference between the lamp current target value and the average current value Ia, and a constant current is controlled to allow the average current value Ia to converge to the lamp current target value, thereby realizing the constant power control of the lamp power.

The determination value (threshold value) of the gradient described in the present embodiment is set based on the following conditions. In case of driving under the conditions that the ratio of the turn ratio of the transformer T1 was 1:4, an inductance value of the primary side was a few μH, a driving frequency was a few 100 kHz, a power source voltage ranged from 6 V to 20 V, and an output voltage ranged from 10V to 40V by using the circuit of the related art example (FIG. 23), when the LED was lighted by changing the power and the output voltage and an output was rapidly increased, a minimum value of the rising gradient of the output voltage was 56 V/ms (almost increased according to a linear function).

When the output voltage is increased, an excessive current flows, and so the increase in the output voltage needs to be adjusted to be within a few volts. Since a ripple of the output voltage when the LED was lighted without flickering was about 1.3 V, the increase in the output voltage was required to be higher than 1.3 V, but lower than 10 V, and for example, it was determined to be 5 V. In this case, a determination time was calculated from the gradient of 56 V/ms, and when the gradient was changed by more than 5 V within 100 μs, the output was controlled to be reduced. The experiment was made by changing power or a load, and it can be said that the threshold value is appropriate.

The threshold value of the output current needs to be determined by the time of about 100 μs as mentioned above, and a few −100 mA of the rated current is almost 0 A at 100 μs, and thus it can be said that setting the threshold value for determining whether or not the gradient of the output current is equal to or lower than −50 A/ms is appropriate.

In the present embodiment, the LED is lighted by applying a positive voltage with respect to a ground thereto, but the LED may also be lighted in the same manner by applying a negative voltage thereto by reversing an anode and a cathode of the LED of the load. In this case, obviously, the sign of the gradient of the output voltage or the output current and the determination of a high level or a low level are also reversed.

Second Embodiment

Figure 6:
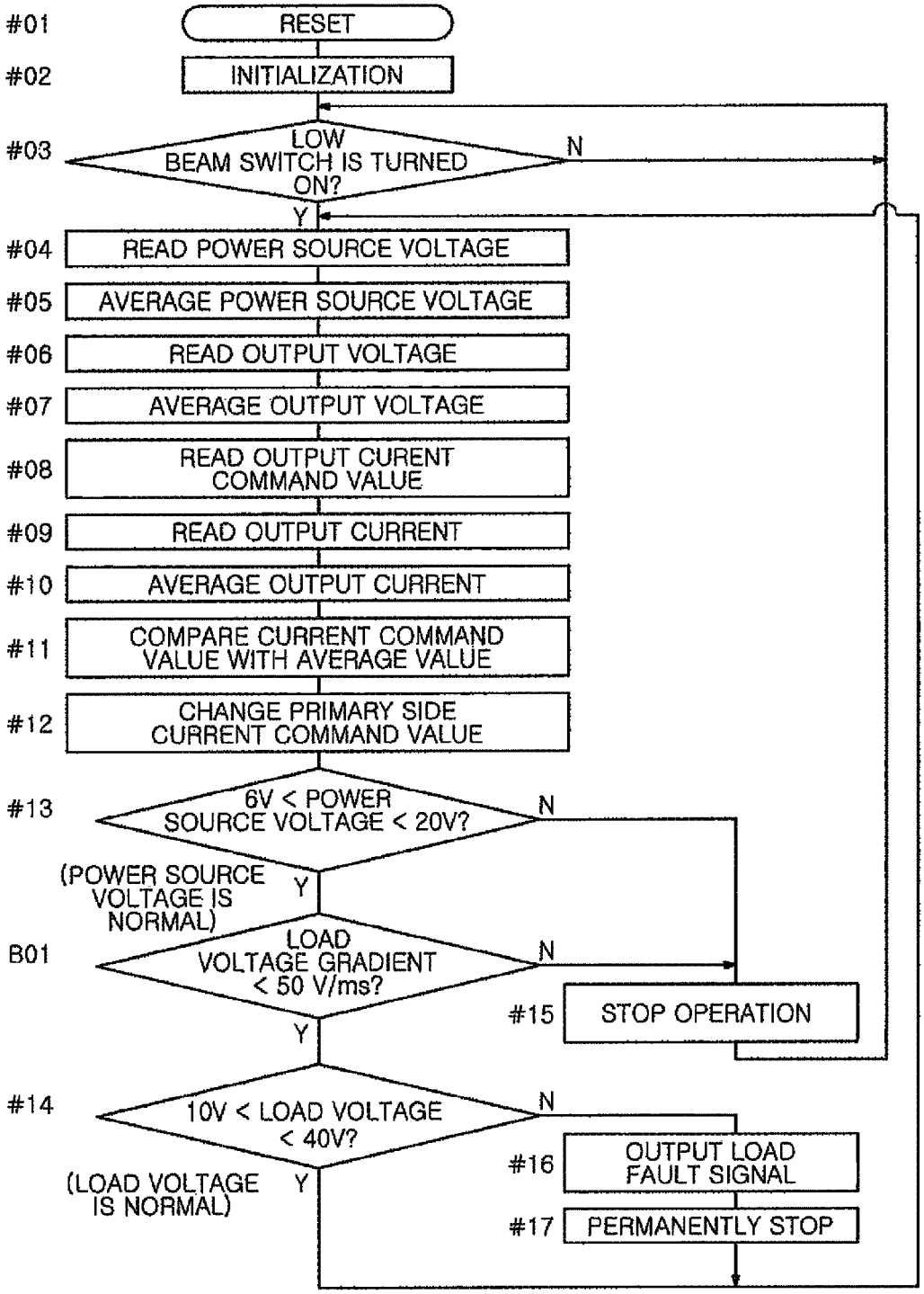
FIG. 6 is a flow chart illustrating an operation in accordance with a second embodiment of the present invention.

FIG. 6 shows a control flow of a control unit used in the second embodiment of the present invention. A configuration of a lighting device is the same as that of the first embodiment. Further, the same reference numerals are used for the same control flows of the related art example (FIG. 24) and the first embodiment (FIG. 2) and a repeated description thereof will be omitted.

The present embodiment is different from the related art example in that a gradient of a load voltage is detected, and when the gradient of the load voltage is 50 V/ms or higher, the process proceeds to step #15 for stopping the circuit operation. After the circuit operation is stopped, the operation starts from step #03 to realize re-lighting in case of load chattering. When the load is actually open and broken down without the load chattering, the load voltage is increased even in case of re-lighting to surpass the normal output voltage upper limit, and thus, it is detected in step #14 to perform permanent stopping. Herein, the circuit operation is first stopped, and then, the circuit is re-operated, thereby preventing a rapid increase in the output current, reliably achieving the effect of reducing a load to the semiconductor light source or the lighting device due to load chattering, and reducing flickering due to the rapid re-operation.

In order to execute this control, step B01 is added, and therefore, when the gradient of the load voltage is 50 V/ms or higher, the process proceeds from the stop operation in step #15 to the re-operation flow in step #03.

In the present embodiment, the start of reducing the output is determined by the gradient of the output voltage, but the same effect can be achieved when it is determined by the gradient of the output current (depending on whether or not it is lower than −50 A/ms) or determined by AND-operating the both gradients. Further, an unnecessary start of reducing the output can be prevented by AND-operating the both gradients similarly to the first embodiment.

In addition, obviously, by increasing the reduction width of the current command value as the gradient of the output voltage (or output current) becomes greater, the effect of preventing damage on the semiconductor light source or the lighting device and the effect of preventing flickering due to the reduction in the output can be balanced (see FIGS. 4B and 4C).

Further, in the present embodiment, the load is described as the semiconductor light source 5, but, even with the high luminance discharge lamp La as shown in FIG. 5, the same effect can be achieved by reducing a command value of the output power.

In the present embodiment, the output current command value itself is reduced as a method for reducing the output, but obviously, the same effect can be obtained by overlapping an offset with the current detection value. This is also applicable to other embodiments.

In the present embodiment, the method of calculating the gradients of the load voltages in the control unit is described, but obviously, a higher speed response can be made by detecting in the following manner.

For example, output voltage values read before 100 μs are outputted through D/A conversion (e.g., on a cycle of 20 μs). The previously D/A converted value and a current value of the voltage detection circuit 3 are inputted to a difference detection circuit, which changes a determination result from LOW to HIGH when a difference thereof is greater than a specific voltage, e.g., 5 V. The output from the difference detection circuit is inputted to an external interrupt circuit or a port for forcibly stopping a timer output or the like of the control unit. The output is reduced by reducing the output current command value by the interrupt circuit or by forcibly stopping the output by the timer output stop. Said obtaining the high speed response by using the external circuit of the control unit or the like can be applicable in the same manner to other embodiments.

Third Embodiment

Figure 7A:
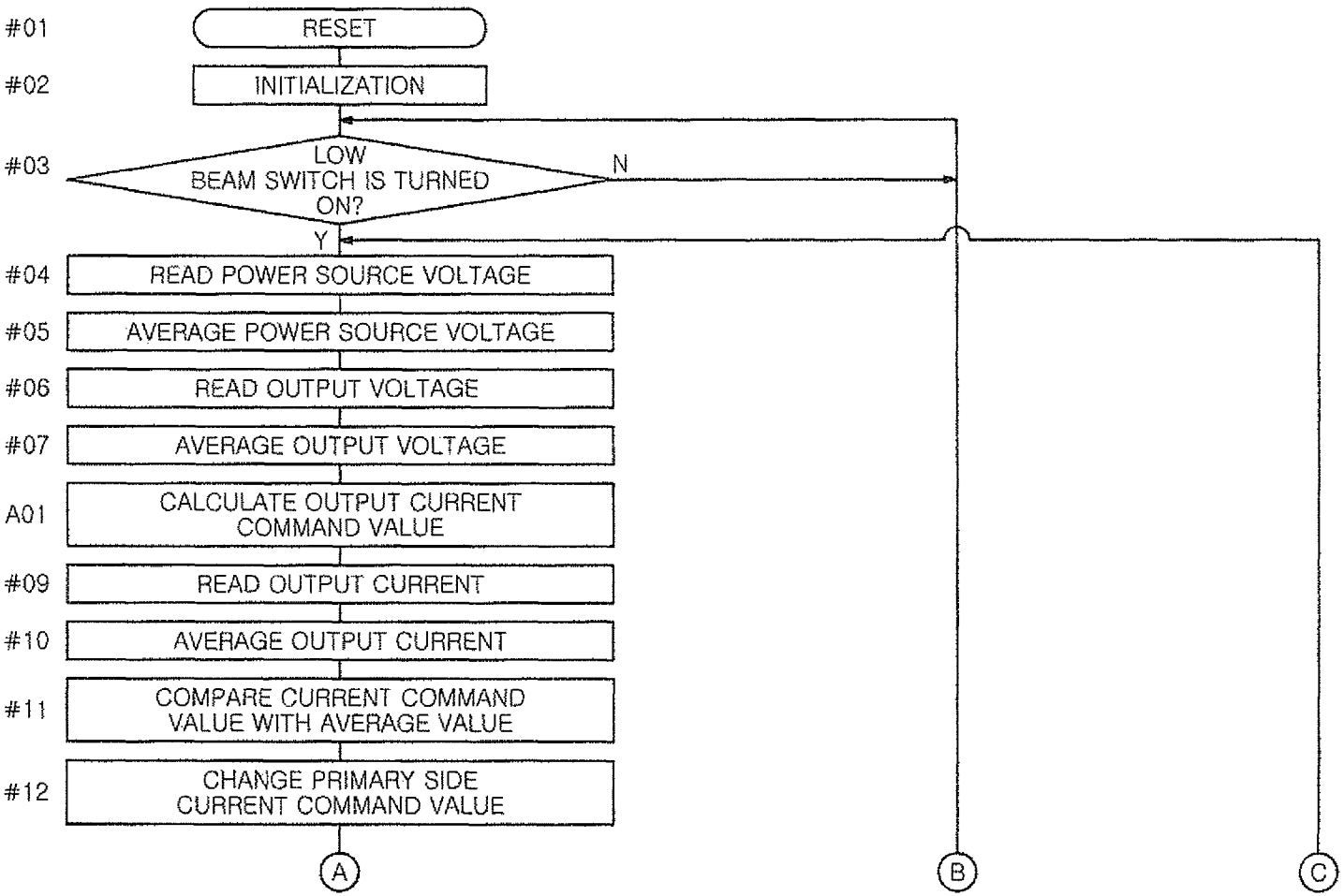
FIGS. 7A and 7B illustrate a flow chart of an operation in accordance with a third embodiment of the present invention.
Figure 7B:
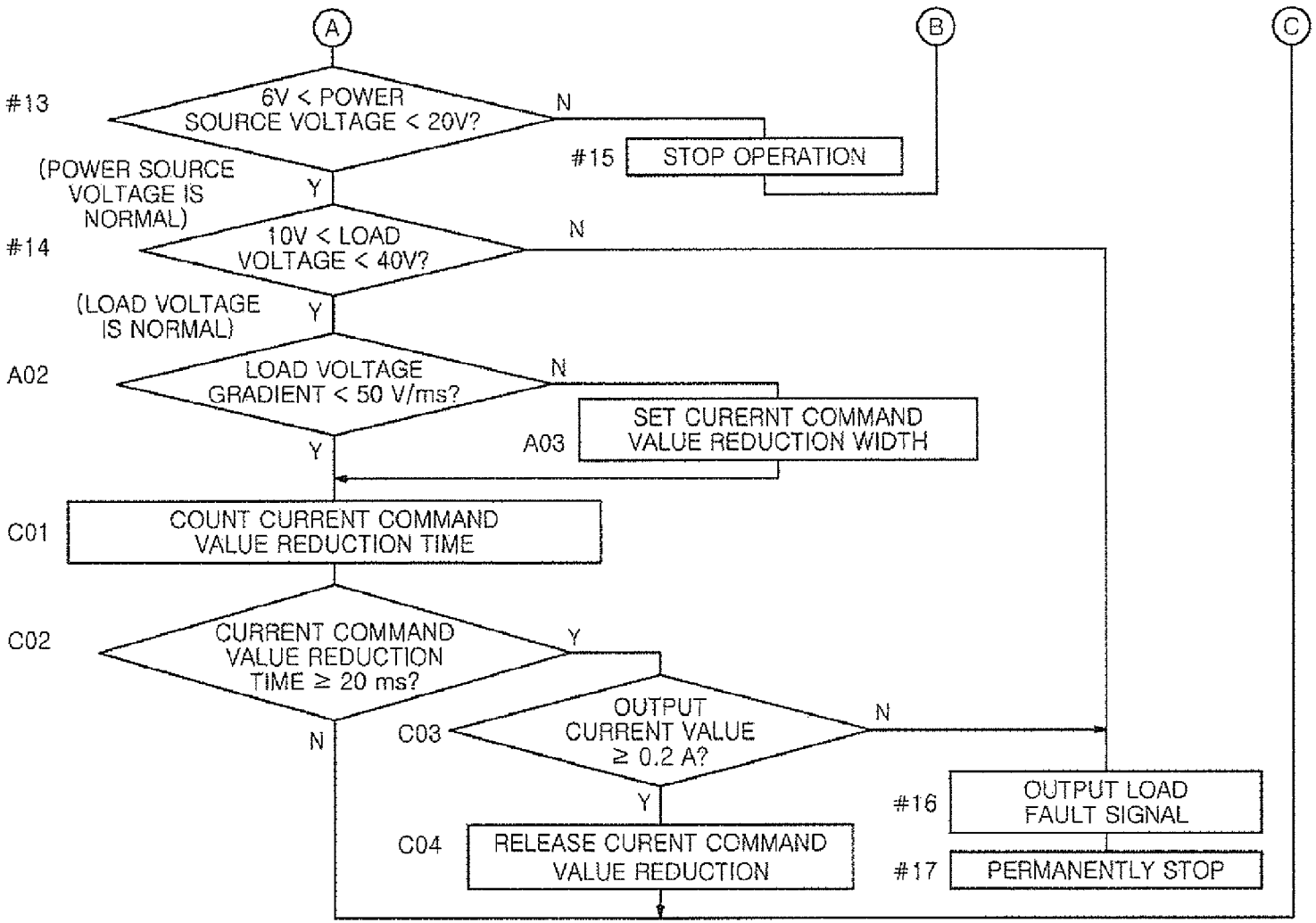

FIGS. 7A and 7B show a control flow of the control unit used in the third embodiment of the present invention. Further, the same reference numerals are used for the same control flows as those of the first embodiment and a repeated description thereof will be omitted.

The present embodiment is different from the first embodiment in that after a current command value is reduced by a gradient of a load voltage, a time since the reduction in the current command value is measured. When an output current value measured after the lapse of a certain period of time (e.g., 20 ms) is greater than a certain output reduction release current value (e.g., 0.2 A), the reducing process of the output current command value is stopped to recover it to the output current command value before the reduction.

To realize this control, a following flow is added to the tail of the control flow of the first embodiment.

In step C01, a time since the reduction in the current command value is counted.

In step C02, it is measured whether or not the lapse time after the reduction in the current command value is 20 ms or greater. When the lapse time is 20 ms or more, the process proceeds to a process (step C03) in which it is determined whether or not to return the output current command value to the value before reduction. When the lapse time is less than 20 ms, the process proceeds to the general constant current control (step #04~).

In step C03, it is determined whether or not the output current value is 0.2 A or greater. When the output current value is 0.2 A or greater, it is determined that the output was reduced because of load chattering, rather than an open failure of a load (the reason is because, in case of the open failure of the load, the output current value is maintained to be 0), and the process proceeds to step C04 in which the reducing of the output current command value is released. When the output current value is lower than 0.2 A, it is determined that the load has an open failure and the process proceeds to steps #16 and #17 in the loop for permanent stop.

In step C04, the reducing of the current command value is released.

Figure 8:
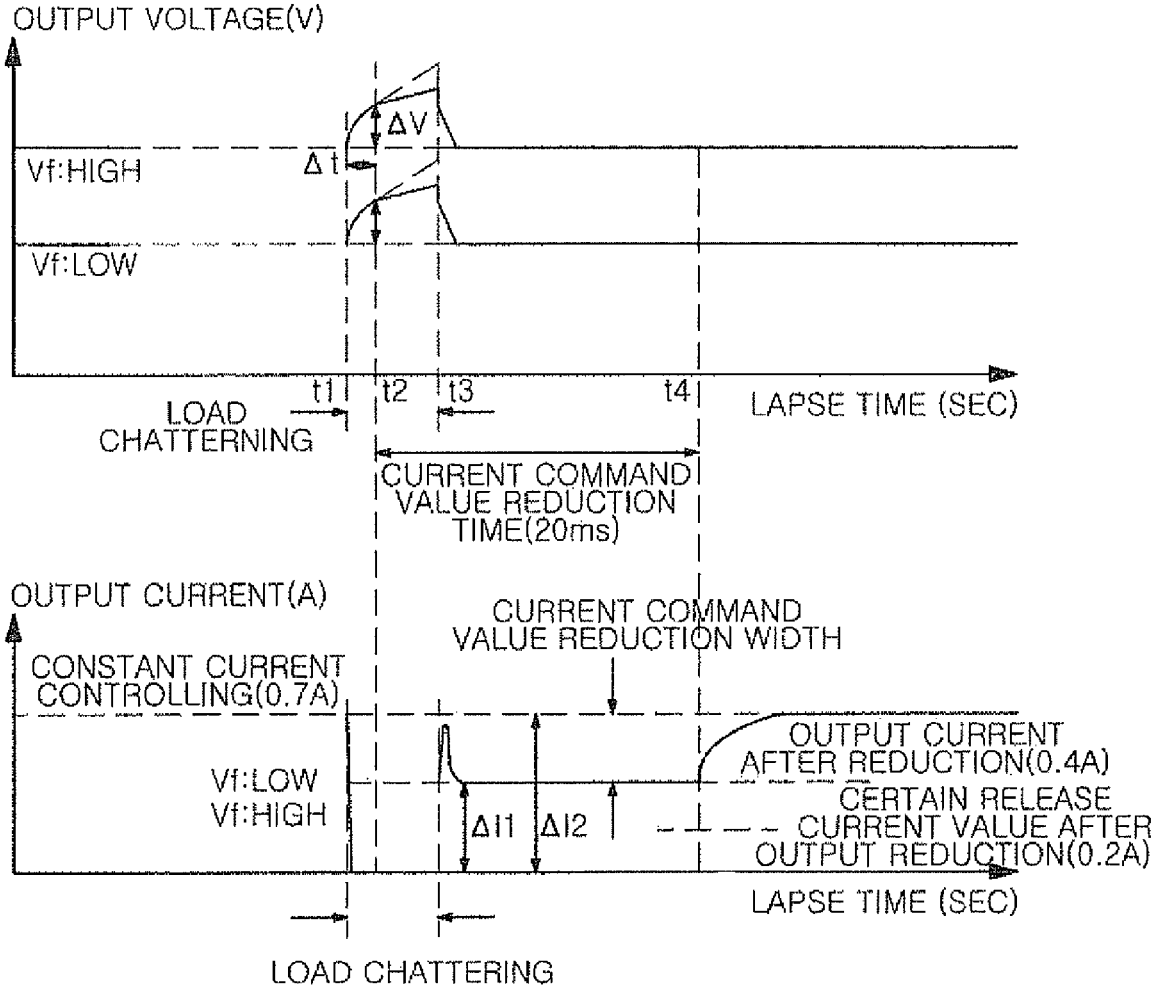
FIG. 8 is a view showing operational waveforms in the occurrence of a load fault in the third embodiment of the present invention.

FIG. 8 shows a change in the output voltage and the output current when load chattering occurs in the case of implementing the present embodiment. In FIG. 8, respective states of outputs in cases where a forward voltage Vf is great and small due to a deviation of the forward voltage Vf are shown. At a time t1, load chattering (load open failure) occurs and an output current is zero. Accordingly, an output voltage is increased, and for example, a voltage change of ΔV (e.g., 5 V) at a time t2 after Δt (e.g., 100 μs) is detected (ΔV/Δt≥50 V/ms). Based on this detection, the output current command value is changed from 0.7 A to 0.4 A.

A primary side current command value is changed by comparing a current command value and an actual current value, and so when the output current command value is lowered, a variation (increase width) of the primary side current command value is also reduced. Thus, an increase in the output voltage indicated by a dotted line (in the related art example) can be suppressed to an increase indicated by a solid line (in present embodiment). Accordingly, load chattering is resolved at a time t3, and when a semiconductor light source is connected, an increase in the output voltage is suppressed, whereby an inrush current can be suppressed and the semiconductor light source or the lighting device can be prevented from being damaged. In the present embodiment, since the output current command value is reduced, the inrush current (overshoot of the output current), which may occur when the load chattering is resolved, can be further reduced.

Thereafter, after a certain period of time (20 ms) has lapsed from the reduction in the output (the reduction in the output current command value: time t2) (inspection of afterglow characteristics), it is detected that the output current value is 0.2 A or greater (time t4), and then, the output current command value is returned to 0.7 A, the value before the reduction. That is, the output current command value is returned to the state before the occurrence of load chattering.

After the output current command value is reduced, if the state is maintained, a dimming state with a low luminous flux continues, and in case of a headlight, the dimming state affects the traveling safety. In the present embodiment, in order to prevent users' eyes from recognizing the dimming state, the output current command value is returned to the state before the reduction when the above certain period of time (20 ms) has lapsed, thus preventing flickering.

Further, in case of a load fault, the operation is stopped based on a determination result after 20 ms, thereby realizing a quick stop of the operation. Generally, in case of load chattering, re-connection is performed within a few ms, it is determined by the time of the present control or shorter time (e.g., 10 ms), whereby load chattering and an load open failure can be discriminated to be determined.

Even though the influence of afterglow or the like may have to be taken into consideration, but in general, when blinking is made at a frequency of 50 Hz or higher, the users' eyes do not recognize flickering. Load chattering may be considered to be reconnected within a few ms, but even when load chattering is longer than that of the considered case, the operation is not possibly stopped. Therefore, in the present embodiment, 20 ms, which is the upper most limit of the range in which flickering is not felt, is used as the certain period of time for reducing the current command value.

In the present embodiment, the current command value reduction time is determined to be 20 ms, and the operation is stopped when it is less than the certain current value (0.2 A). However, even in the occurrence of the load open failure, if the load voltage is within the normal range (10 V to 40 V), the lighting device is not damaged, and so, obviously, the same effect can be obtained although the lighting device is continuously operated, rather than stopping the operation thereof (by proceeding to step #04 in case of NO in step C03), and the load open can be accurately determined with a longer time.

In the present embodiment, whether to release the reduction in the output current command value is determined by determining whether or not the output current value is equal to or greater than the certain output reduction release current value after the certain period of time. However, when the load is an open failure, there is no such a thing as an increase in the output current. Thus, obviously, without having to wait for the certain period of time, the release of the reduction in the output current command value may also be determined by determining whether or not the output current value is equal to or greater than the certain current value, and a lighting device having less flickering can be realized by shortening the dimming lighting state.

Fourth Embodiment

Figure 9A:
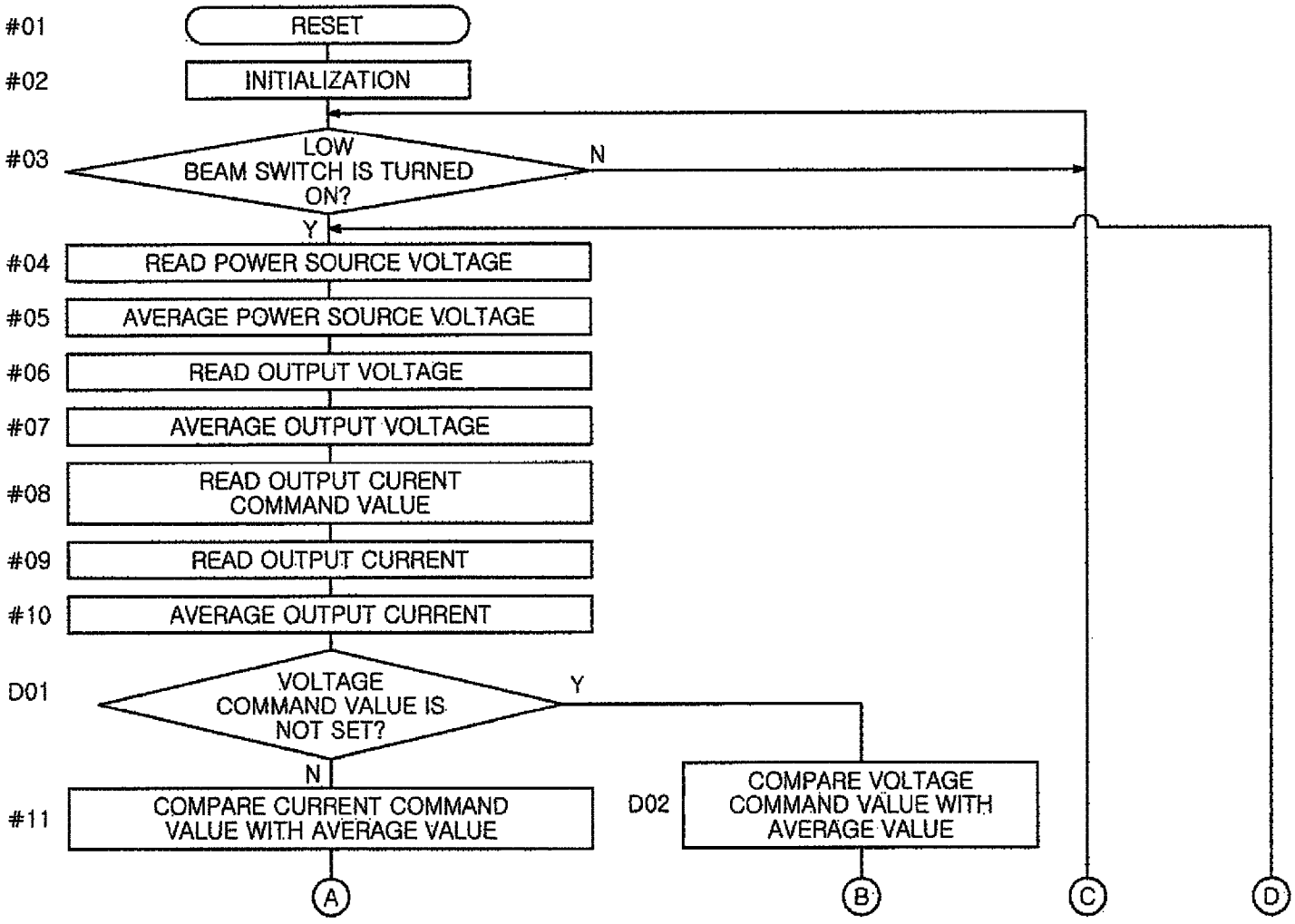
FIGS. 9A and 9B illustrate a flow chart of an operation in accordance with a fourth embodiment of the present invention.
Figure 9B:
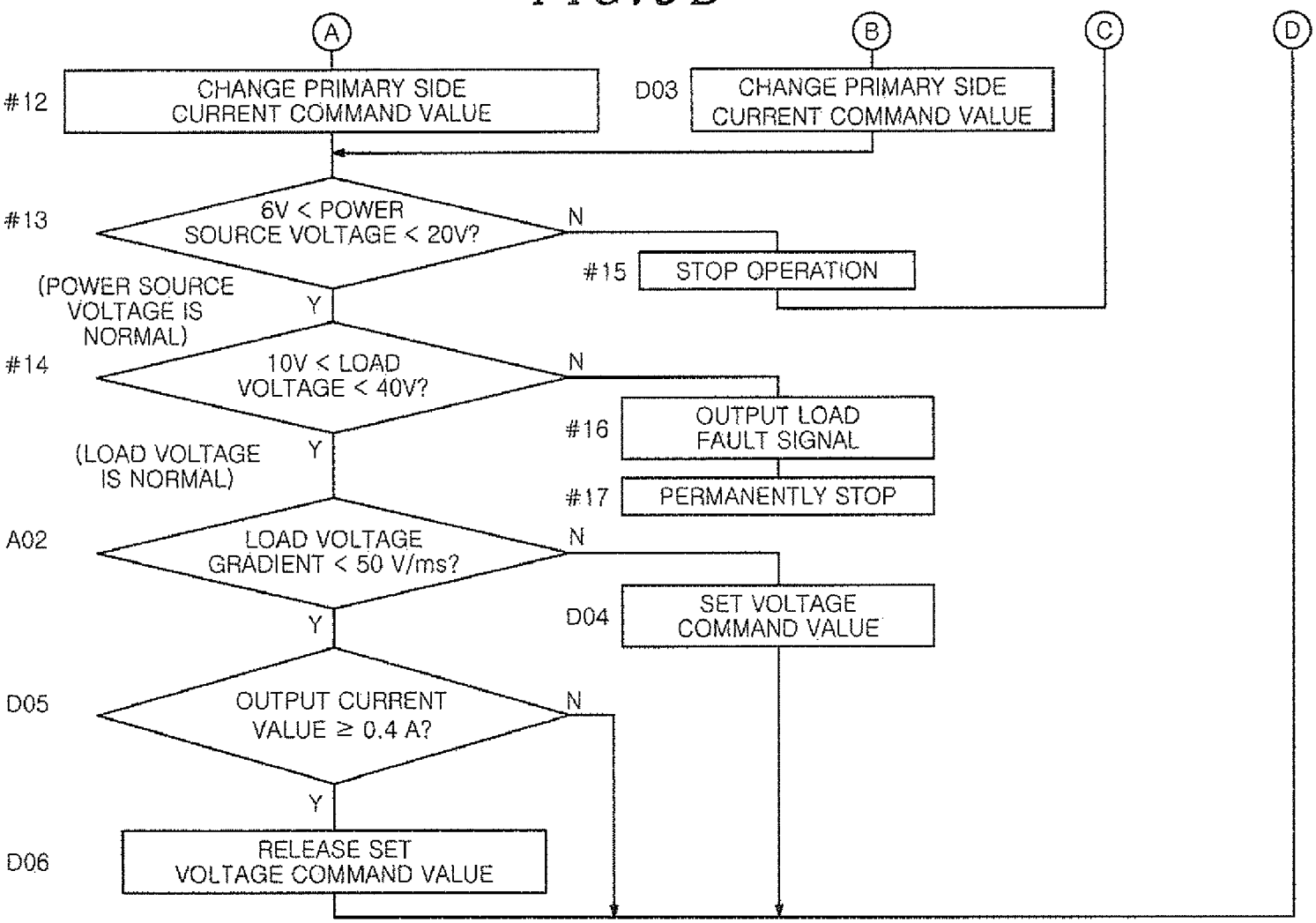

FIGS. 9A and 9B show a control flow of the control unit used in the fourth embodiment of the present invention. Further, the same reference numerals are used for the same control flows as those of the first embodiment and a repeated description thereof will be omitted.

The present embodiment is different from the first embodiment as follows. In the first embodiment, the output current command value is reduced when the gradient of the load voltage is equal to or greater than the certain gradient (i.e., 50 V/ms), while in the present embodiment, when the gradient of the load voltage is equal to or greater than a certain gradient, a constant voltage control is performed, rather than the constant current control.

In order to realize this control, the control flow of the first embodiment is changed as follows.

In step D01, it is determined whether or not a voltage command value has been set before steps #11 and #12 in which a current command value and a detected current value are compared and the primary side current command value is changed. When the voltage command value has been set, the process proceeds to the steps D02 and D03 for executing constant voltage control.

In step D02, since the output voltage command value has been set, the voltage command value and the detected voltage value are compared and calculated.

In step D03, the primary side current command value Ic is changed by said comparison and calculation. In steps D02 and D03, constant voltage control is realized.

In step D04, when the gradient of the load voltage is equal to or greater than a certain gradient, the reduction width of the output current command value is set in case of the first embodiment. However, in the present embodiment, the output voltage command value is set, instead. Once the output voltage command value is set in step D04, steps D02 and D03 for the constant voltage control are performed depending on a determination in step D01.

In step D05, it is determined whether or not an output current lowered by load chattering is equal to or greater than a certain output reduction release current value (e.g., 0.4 A in the present embodiment). When the output current is equal to or greater than the certain output reduction release current value, the process proceeds to step D06 and the output voltage command value set in step D04 is released.

In step D06, the output voltage command value is released, as described above. When the output voltage command value is released, the process proceeds to steps #11 and #12 depending on a determination in step D01 and the constant current control is resumed.

Figure 10:
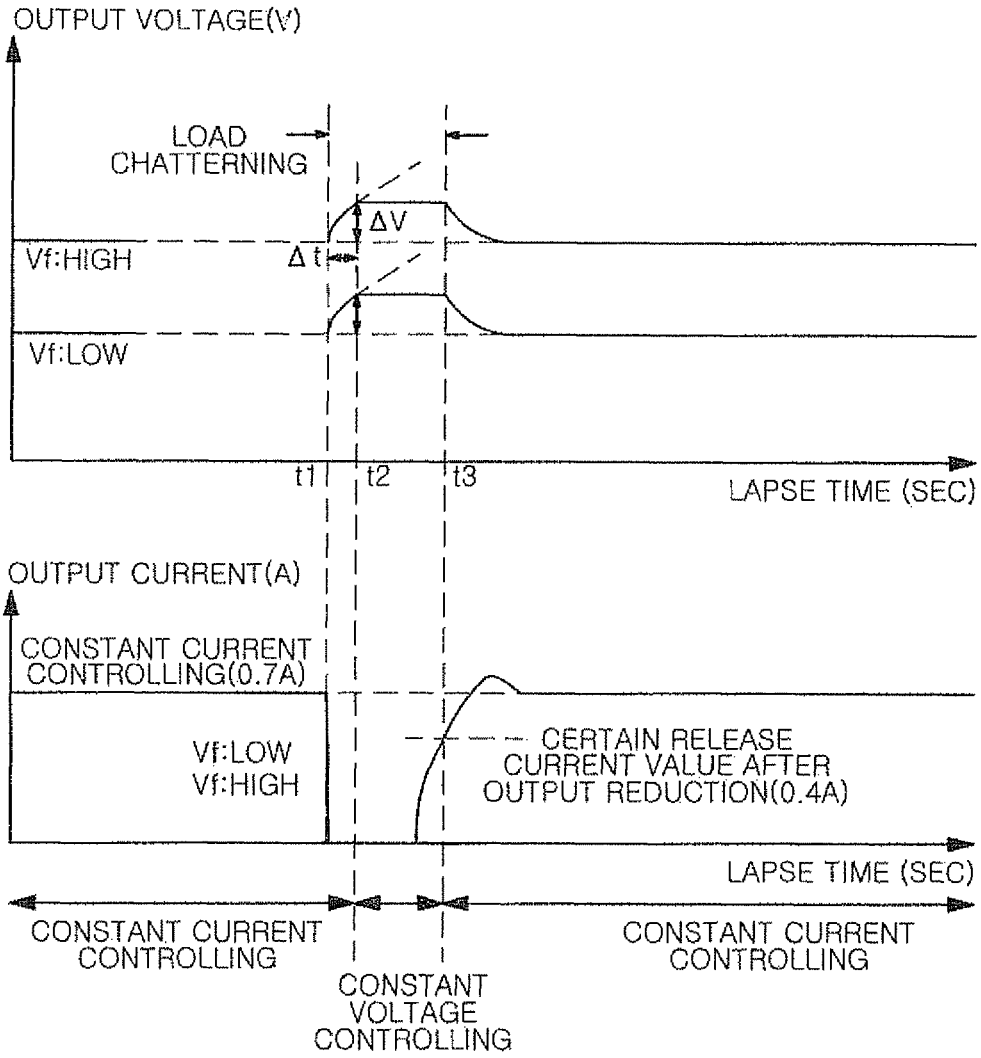
FIG. 10 shows graphs showing operational waveforms in the occurrence of a load fault in the fourth embodiment of the present invention.

FIG. 10 shows a change in the output voltage and the output current when load chattering occurs in the case of implementing the present embodiment. In FIG. 10, respective states of outputs in cases where a forward voltage Vf is great and small due to a deviation of the forward voltage Vf are shown.

At a time t1, load chattering (load open) occurs and an output current is zero. Accordingly, an output voltage is increased, and for example, a voltage change of ΔV (5 V) at a time t2 after Δt (100 μs) is detected (ΔV/Δt≥50 V/ms). Based on this detection, the output voltage command value is set with the voltage value at timing when the increase in the load voltage is detected.

Thereafter, the control unit 10 drives the DC/DC converter 1 by the constant voltage control such that an output voltage becomes constant. When load chattering is resolved and the output current value reaches the certain output reduction release current value (0.4 A)(time t3), it is changed to constant current control and the output returns to the state before the occurrence of the load chattering.

In accordance with the present embodiment, an increase in the output voltage in a load open can be prevented, and an overcurrent when the load is connected again can be prevented. Further, since the constant voltage control is returned to the constant current controlling when the output current value reaches the certain current, an output reduction period when load chattering occurs can be shortened, thereby reducing flickering of light.

In addition, in case where the load has an open failure, rather than load chattering, when the constant voltage control is maintained for a certain period of time, obviously, process for permanently stopping the operation is added to cope with the open failure of the load.

Furthermore, in the present embodiment, the voltage value for executing the constant voltage control is set with a voltage value after the load has a rapid change, but obviously, a value just before the load has a rapid change may be stored and used as the voltage value for the constant voltage control, thereby more reliably preventing an overcurrent (see claim 10)

Additionally, in a case where the value just before the load has a rapid change is used as a voltage value of constant voltage control, a subtle deviation of A/D conversion may occur due to a change in an output voltage ripple or the like depending on a connection or disconnection of the load, and when the load is connected, an output voltage may be reduced to be lower than the forward voltage of of the load and the output current may not flow up to the certain current (0.4 A). In this case, the constant voltage control can be more reliably returned to the constant current control by setting the voltage value for executing the constant voltage control to be higher by a certain voltage (e.g., 2 V to 3 V) than the value just before the load has a rapid change.

In the present embodiment, load chattering is detected by using the gradient of the load voltage. However, a load chattering causes an increase in the output voltage as well as a decrease in the output current, and so load chattering occurs only when the gradient of the load voltage is equal to or greater than a certain gradient or the gradient of the load current is lower than a certain gradient (here, the certain gradient has a minus value). Thus, the occurrence of load chattering can be more accurately detected by setting the output voltage command value.

Fifth Embodiment

Figure 11:
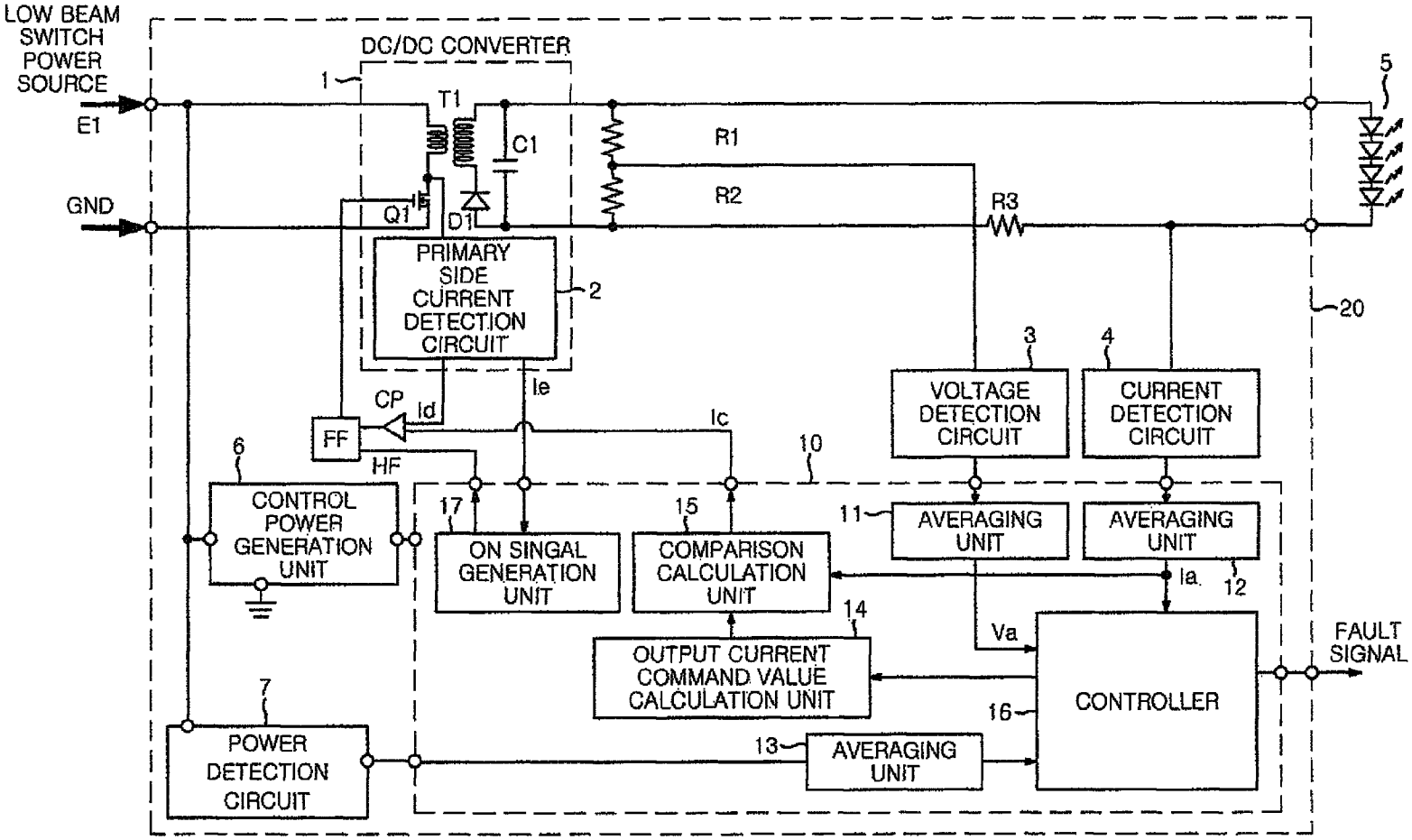
FIG. 11 is a circuit diagram in accordance with a fifth embodiment of the present invention.
Figure 12A:
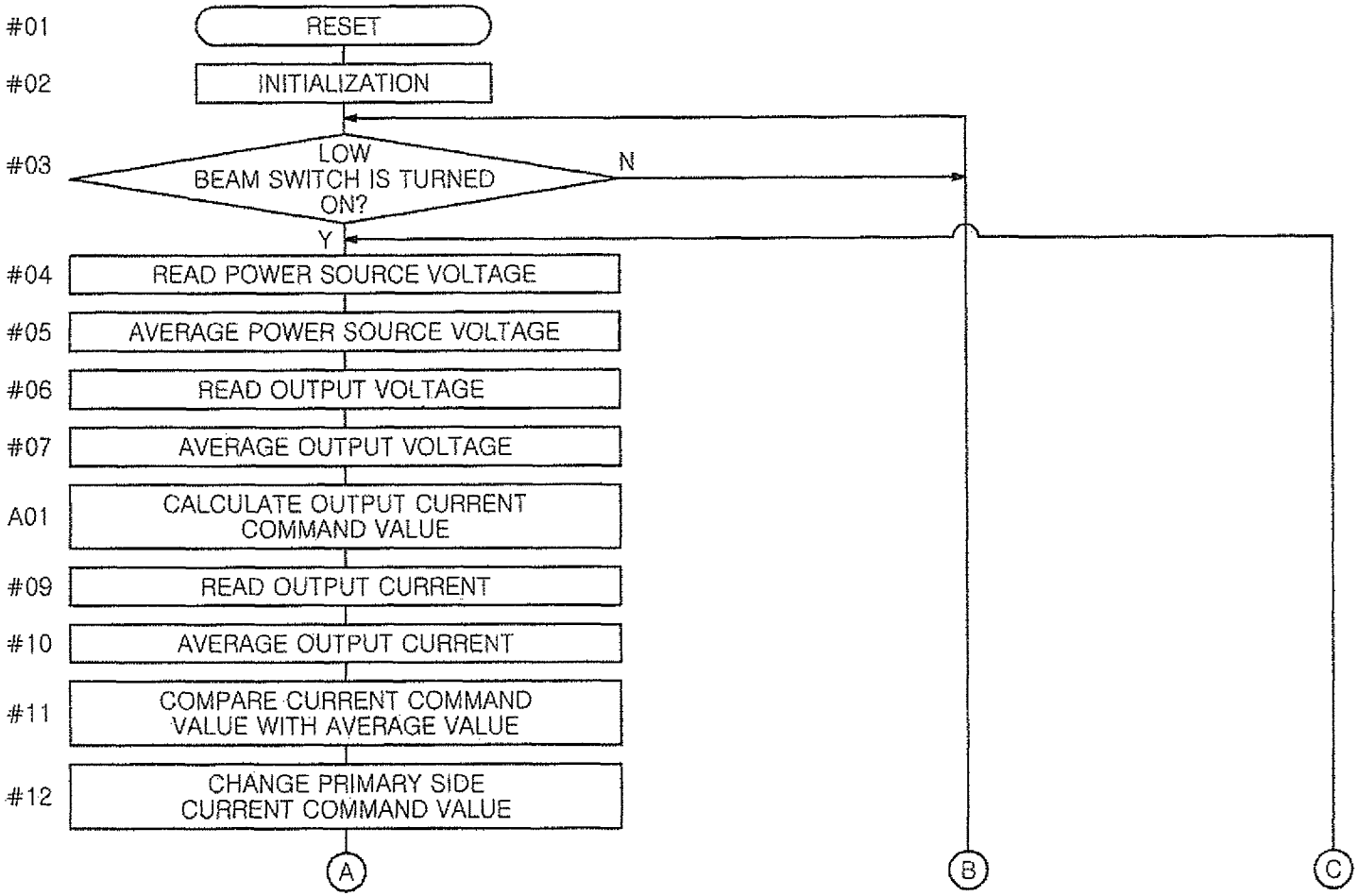
FIGS. 12A and 12B illustrate a flow chart of an operation in accordance with the fifth embodiment of the present invention.
Figure 12B:
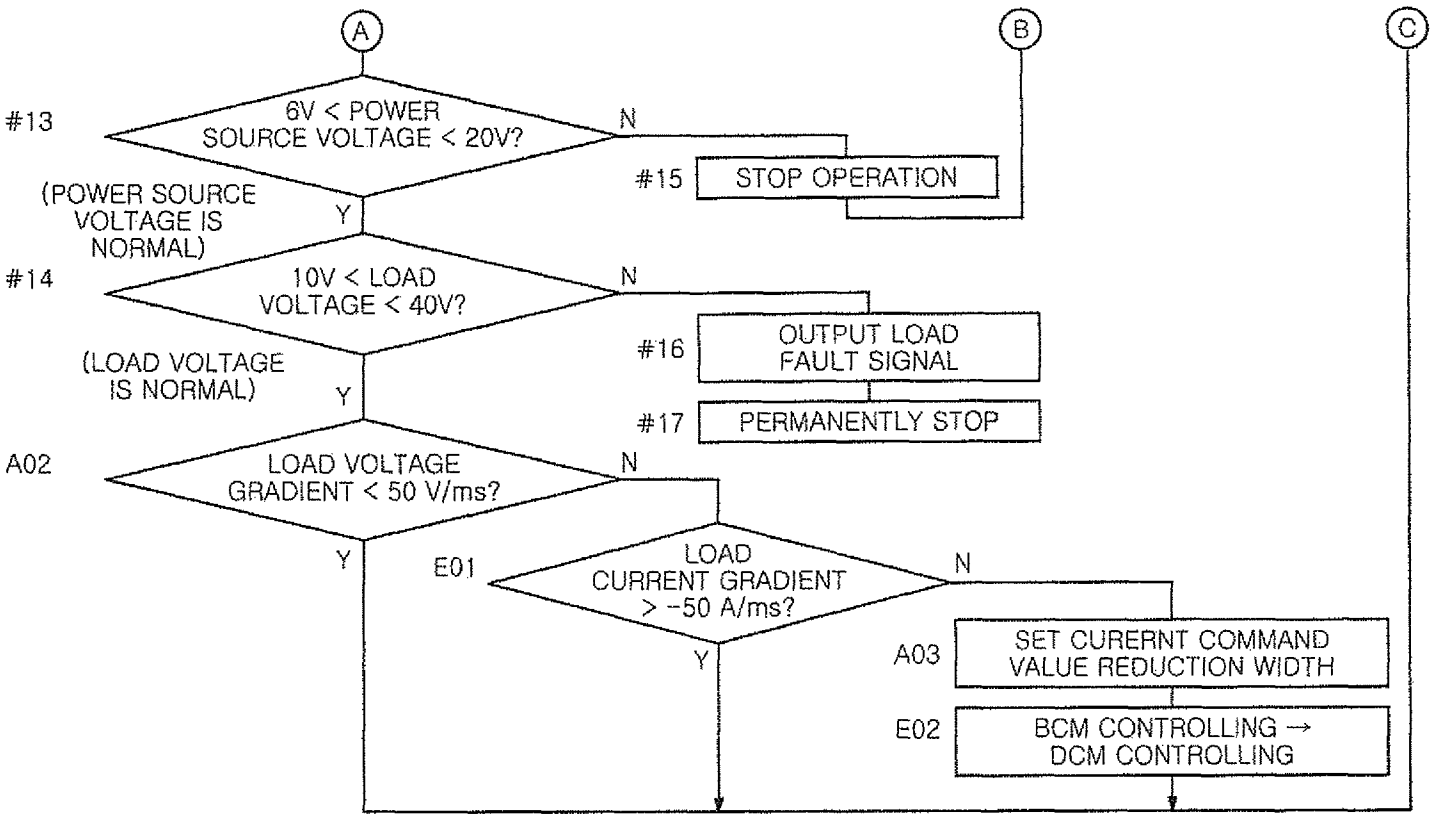

FIG. 11 shows a configuration of a lighting device in accordance with a fifth embodiment of the present invention. Further, in FIGS. 12A and 12B, a control flow of a control unit of the present embodiment is shown. Also, the same reference numerals are used for the same components as those of the first embodiment and a repeated description thereof will be omitted.

Generally, in a switching power source for executing power conversion by accumulating energy in a coil or a transformer when a switching device is turned on and discharging the energy when the switching device is turned off, BCM control (Boundary Current Mode) for turning on again the switching device when discharging of energy is completed as the switching device is turned off may be employed to enhance circuit efficiency (in the present embodiment, a flyback circuit is illustrated as the switching source, but any switching power source such as a step-up chopper, a step-down chopper, a cuke circuit or the like may be used).

Therefore, in the present embodiment, a secondary side current discharge signal Ie is prepared to notify the control unit 10 of the discharge of the secondary side current. Upon receiving the secondary side current discharge signal Ie, the control unit 10 outputs an ON signal (HF) from an ON signal generation unit 17. A switching signal of the DC/DC converter 1 is generated by a drive circuit (RS flipflop FF) based on an OFF timing determined by the ON signal HF, the primary side current detection value Id, and the primary side current command value Ic. Through this configuration, the BCM control is realized.

Further, the primary side current detection circuit 2 detects a primary side current with an OP amplifier or the like based on the fact that a voltage between a drain and a source of the switching device Q1 is almost proportional to a drain current when the switching device Q1 is in an ON state. In addition, when the switching device Q1 is in an OFF state, the primary side current detection circuit 2 detects that a secondary side current is completely discharged and outputs a secondary side current discharge signal Ie, when an induced voltage of a primary side coil of the transformer T1 is lost while the switching device Q1 is in an OFF state.

The control flow of the present embodiment is different from that of the first embodiment as follows. That is, in the first embodiment, the determination of setting the reduction width of the output current command value is executed (A03: output is reduced) depending on the determination result whether or not the gradient of the load voltage is equal to or greater than a certain voltage gradient (50 V/ms). Meanwhile, in the present embodiment, the reduction width of the output current command value is set when the gradient of the load voltage is equal to or greater than the certain voltage gradient and when the gradient of the load current is smaller than a certain current gradient (−50 A/ms). By determining from both sides of the load voltage and the load current, a load fault can be more accurately detected.

Further, although the output current command value is reduced, a delay time is generated in an actual output reduction due to an external circuit. In the present embodiment, the foregoing BCM control is executed in general, but the BCM control is changed into a DCM (Discontinuous Conduction Mode) control depending on an output reduction (reduction in output current command value). The DCM control refers to a control to turn on the switching device with a delay time after the energy accumulated in the coil or the transformer is discharged.

Figure 13:
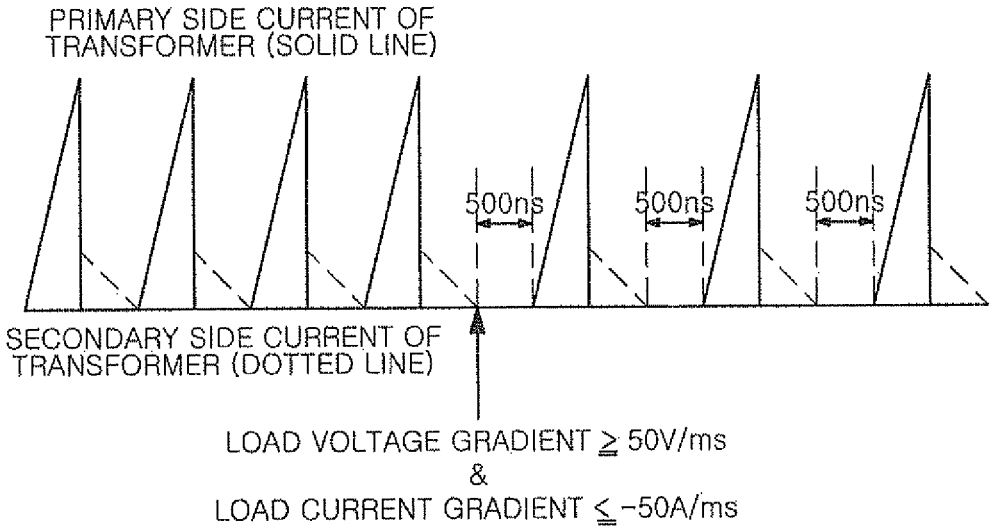
FIG. 13 is a view showing operational waveforms in accordance with the fifth embodiment of the present invention.

FIG. 13 shows a state of the change in switching at this time. Before a rapid change in each of the load voltage and the load current is detected, the primary side current of the transformer starts to be electrically connected in synchronization with a zero-cross of the secondary side current of the transformer. In this respect, after the rapid change in the load state is detected, the primary side current of the transformer starts to be electrically connected after the zero-cross of the secondary side current of the transformer, e.g., after the lapse of 500 ns.

An output from the flyback circuit is proportional to the switching frequency. Thus, the rapid output reduction can be realized by changing into the DCM controlling in comparison to the case where only the output current command value is reduced. In particular, when determination of a rapid change in the load or output reduction is executed by using a microcomputer, a delay time is generated at any event due to a serial control of the microcomputer. When the delay time overlaps with a delay time by an external circuit, the operation for the occurrence of a load fault is delayed. Thus, the overcurrent can be more reliably prevented by adding the direct output reduction in accordance with the present embodiment.

Even with the DCM control, the constant current control can be executed, so the same effect as that of the foregoing the first embodiment can be obtained in spite of the changing into the DCM control.

In the present embodiment, the output current command value is reduced as a method of reducing an output, but when it is changed to constant voltage controlling, although the BCM controlling is changed to the DCM controlling, the same effect can be obtained.

In the present embodiment, the discontinuous time in the DCM control is 500 ns, but obviously, the same effect can be obtained without being limited to the time. Further, by varying the discontinuous time depending on a width of the change in an output (i.e., the discontinuous time is lengthened as the change width is larger), when a change width is large, i.e., when an output needs to be quickly reduced, the effect of reducing the output becomes increased and more stable lighting device can be realized.

In the present embodiment, the rapid output reduction is executed by changing the BCM control to the DCM control, but besides, obviously, the rapid output reduction can be executed by reducing the primary side current command value Ic, by overlapping the offset with the primary side current detection value Id or the like.

Sixth Embodiment

Figure 14A:
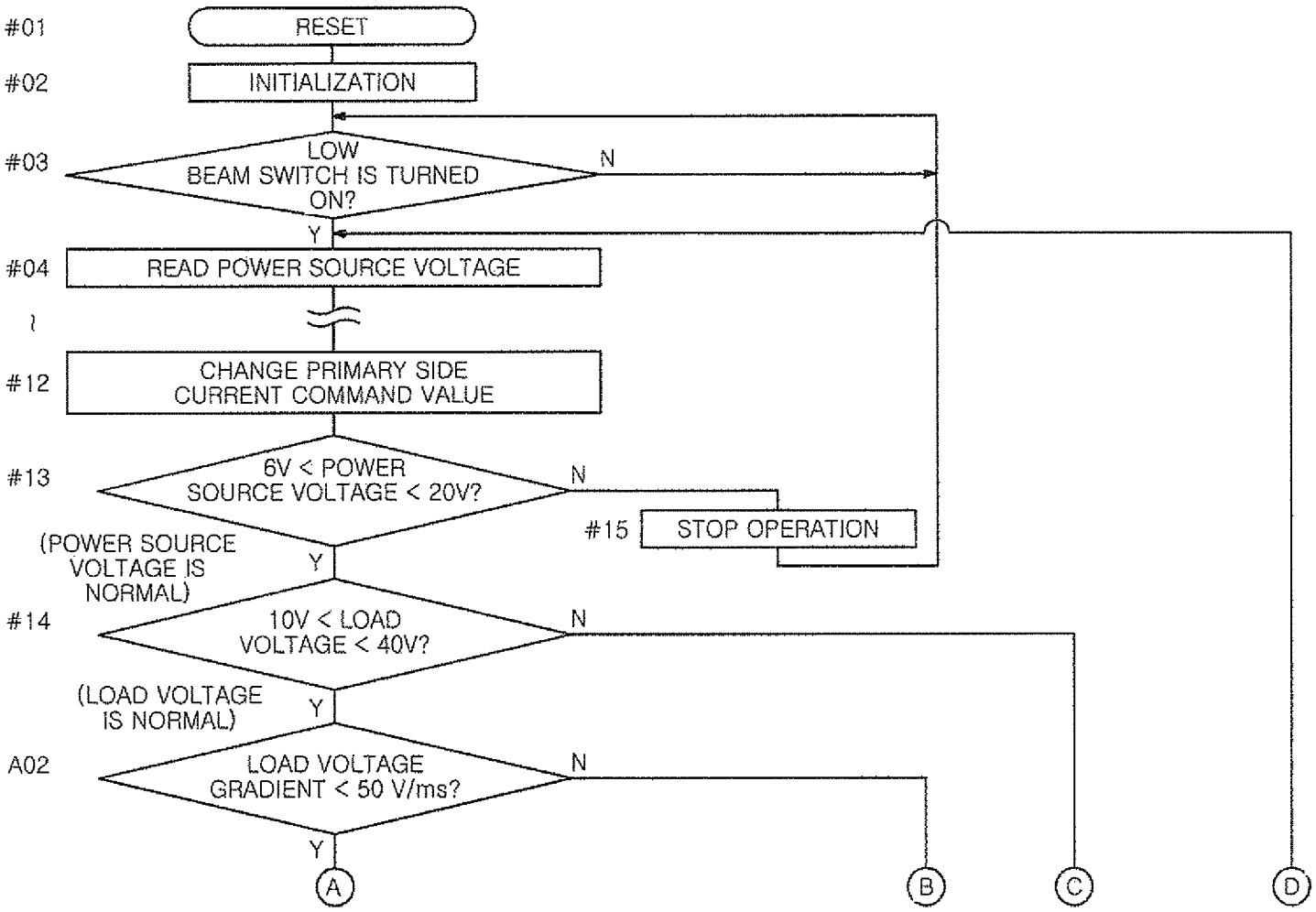
FIGS. 14A and 14B illustrate a flow chart of an operation in accordance with a sixth embodiment of the present invention.
Figure 14B:
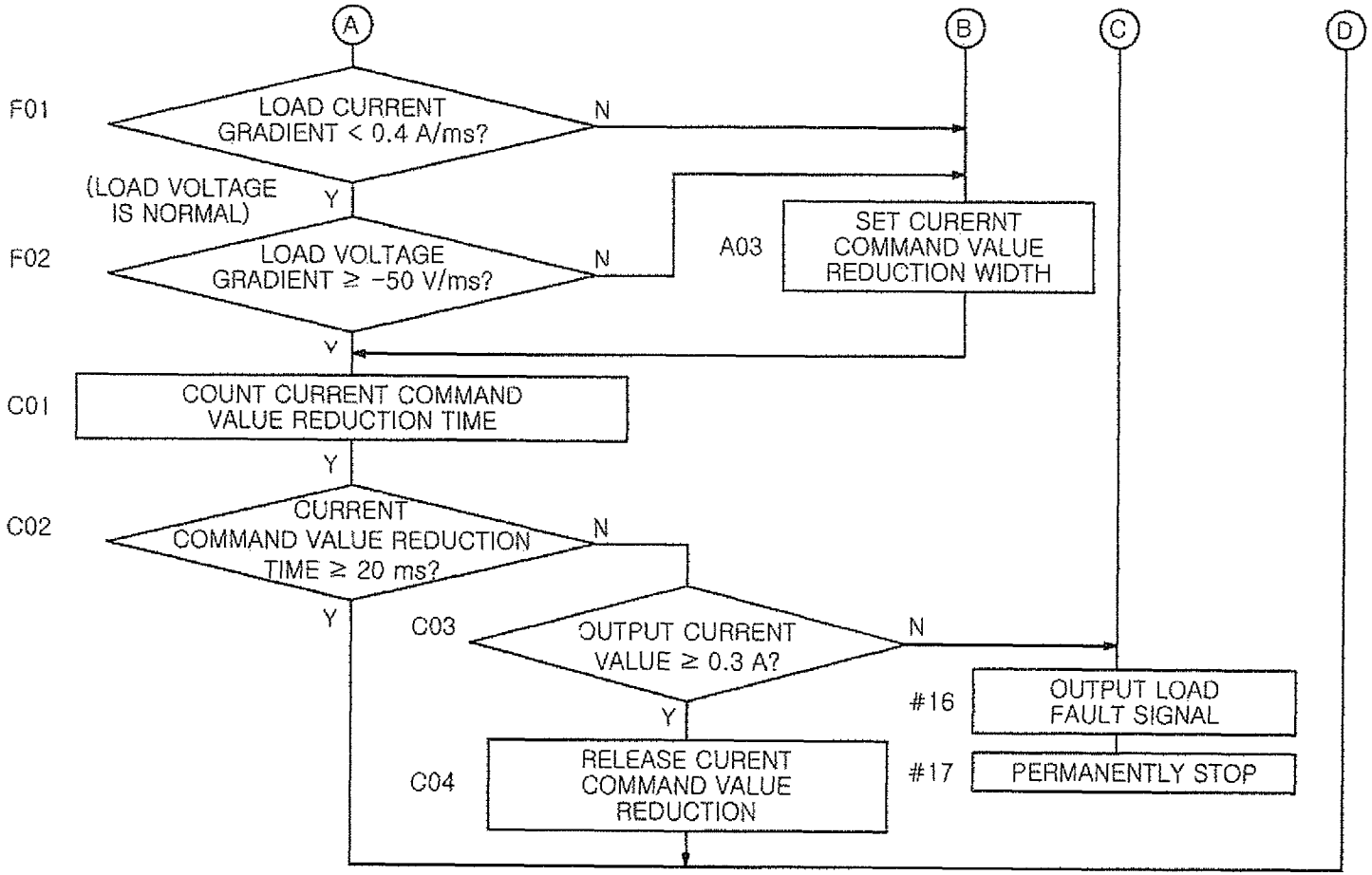

FIGS. 14A and 14B show a control flow of a control unit used in the sixth embodiment of the present invention. The configuration of the lighting device is the same as that of the first embodiment. The same reference numerals are used for the same control flows as those of the third embodiment and a repeated description thereof will be omitted. Although not shown, the steps #04 to #12 are the same as those of FIGS. 7A and 7B.

In the third embodiment, when the gradient of the load voltage is equal to or greater than a certain voltage gradient (50 V/ms), the reduction width of the output current command value is set (step A03), but in the present invention, in addition thereto, steps F01 and F02 are added in which, when the gradient of the load current is equal to or greater than a certain current gradient (0.4 A/ms) (step F01) or when the gradient of the load voltage is smaller than a certain voltage gradient (−50 V/ms) (step F02), the process proceeds to step A03 for reducing the output current command value.

Figure 15:
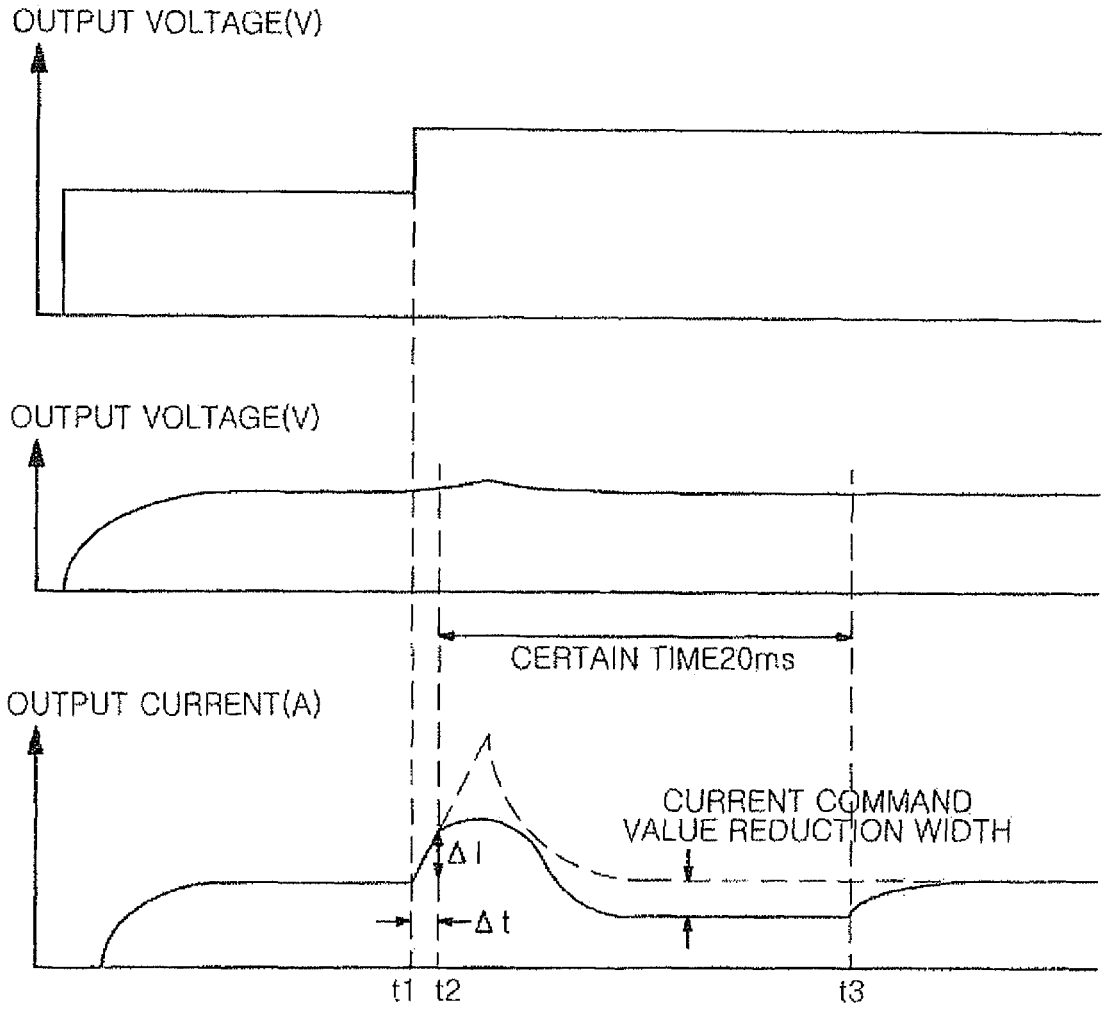
FIG. 15 presents graphs showing operational waveforms in the occurrence of a power fault in the sixth embodiment of the present invention.

FIG. 15 shows a change in the output voltage and the output current when the power source voltage is rapidly increased in the case of implementing the present embodiment. The power source voltage is rapidly increased during the constant current control at a time t1, and accordingly, an output current is increased. When it is detected that the output current has been changed by more than ΔI (e.g., 0.12 A) (i.e., it is detected that the gradient has been changed to 0.4 A/ms) at a time t2 after the lapse of a time Δt (300 μs), the output is reduced (step F01), Through this control, the semiconductor light source or the lighting device can be prevented from being damaged due to an application of an excessive current when the power source voltage is rapidly increased. If the output is not reduced, an output current indicated by the dotted line would flow. However, in accordance with the present embodiment, the output current waveform indicated by the sold line can be achieved.

Further, after the output is reduced (the output current command value is reduced), when a certain period of time (20 ms) has lapsed, it is determined whether or not to return the output current command value to the state before the reduction, thereby lighting the semiconductor light source such that a user does not recognize flickering.

Figure 16:
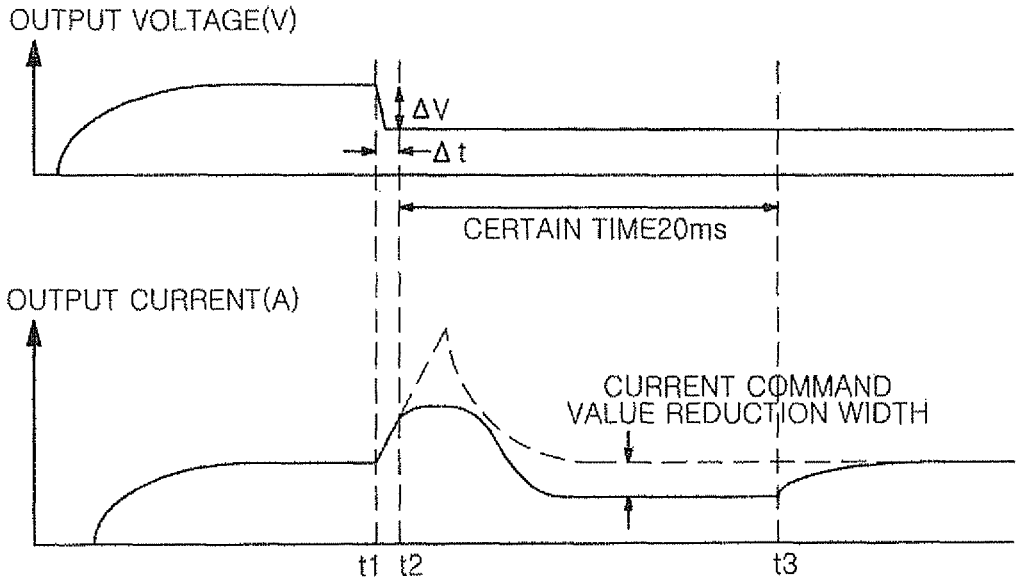
FIG. 16 presents graphs showing operational waveforms in the occurrence of a partial load short-circuit in the sixth embodiment of the present invention.

Next, FIG. 16 shows a change in the output voltage and output current when the LED of an output is partially shorted in the case of implementing the present embodiment. An output voltage is rapidly lowered at the time t1 due to the partial short-circuit in the LED of the output. Thus, the output current is increased and an excessive current flows. When it is detected that the output voltage has been changed by more than −ΔV, e.g., −5 V, (i.e., load voltage gradient<−50 V/ms) at the time t2 after the lapse of Δt (e.g., 100 μs), the output is reduced (step F02).

Through this control, the semiconductor light source or the lighting device can be prevented from being damaged due to a flow of an excessive current when a portion of the load has a fault to be short-circuited. If the output was not reduced, an output current indicated by the dotted line would flow. However, the output current waveforms indicated by the solid line can be achieved by employing steps in accordance with the present embodiment.

Further, after the output is reduced (the output current command value is reduced), when a certain time (20 ms) has lapsed, it is determined whether or not to return the output current command value to the state before the reduction, thereby lighting the semiconductor light source such that a user does not recognize flickering (in steps C01 to C04).

In accordance with the present embodiment, the damage on the semiconductor light source or the lighting device due to a change in power or a load can be prevented.

In the present embodiment, a change in the power source voltage or a partial short-circuit in the LED is detected based on a rapid increase in the output current (FIG. 15) or a rapid decrease in the output voltage (FIG. 16), but in case of more accurately detecting each state, obviously, the detection precision can be enhanced by detecting by AND-operating two conditions for each fault types as follows.

1) In a load open or a load chattering, an output voltage is increased and an output current is decreased. In this case, the voltage changes by 5 V per 100 μs and the output current becomes almost zero (referring to a change width, it is −0.7 A: rated current value).

2) In a (partial) load short, the output voltage is decreased and the output current is increased. In this case, the voltage changes by 5 V per 100 μs and the output current is increased by a gradient of about 50 A/ms.

3) In the rapid increase in the power source voltage, the output voltage is increased (there is no substantial change) and the output current is increased. In this case, the output voltage is scarcely changed and the output current changes by 120 mA per 300 μs.

Needless to say, the method or values for reducing the output can be changed by the fault types of 1) to 3) described above.

Also in this embodiment, obviously, the effect of reducing the output can be more rapidly achieved by executing BCM control as the general constant current control and changing the BCM control to the DCM control when a load is rapidly changed.

In the present embodiment, a certain determination time Δt is prepared in order not to respond to an instantaneous change, and ΔI or ΔV after the lapse of the determination time Δt is detected by using an average value thereof, but obviously, the same effect can be obtained through detection by using a momentary value. Further, detection may be more finely performed within the determination time Δt, each detected value may be stored, and a rapid change in a load may be determined based on a tendency of the change (such as a continuous increase or the like). In this manner, the detection of the gradient of the change in the load is not affected by the detection period or the number of storage.

The gradient illustrated in the present embodiment is set based on the following conditions. In case of driving the circuit of the related art example (FIG. 23) under the conditions that a ratio of the turn ratio in the transformer was 1:4, an inductance value of the primary side was a few μH, a driving frequency was a few 100 kHz, a power source voltage ranged from 6 V to 20 V, and an output voltage ranged from 10 V to 40 V, and the LED was lighted by changing the power and the output voltage to rapidly increase the power source voltage, a minimum value of the rising gradient of the output current being 0.45 A/ms (maximum was 1.5 A/ms) (almost increased linearly). When the LED was lighted without flickering, a ripple of the output current was about 70 mA, and so the output was controlled to be reduced when there was a change in the current by more than 120 mA per 300 μs (0.45 A/ms is equivalent to a change of 135 mA per 300 μs) in order to reliably detect a gradient depending on a change in power without affecting a gradient of an instantaneous ripple (see claim 4). The experiment was conducted by changing power or the load, and so it can be said that the threshold value is appropriate.

Seventh Embodiment

Figure 17A:
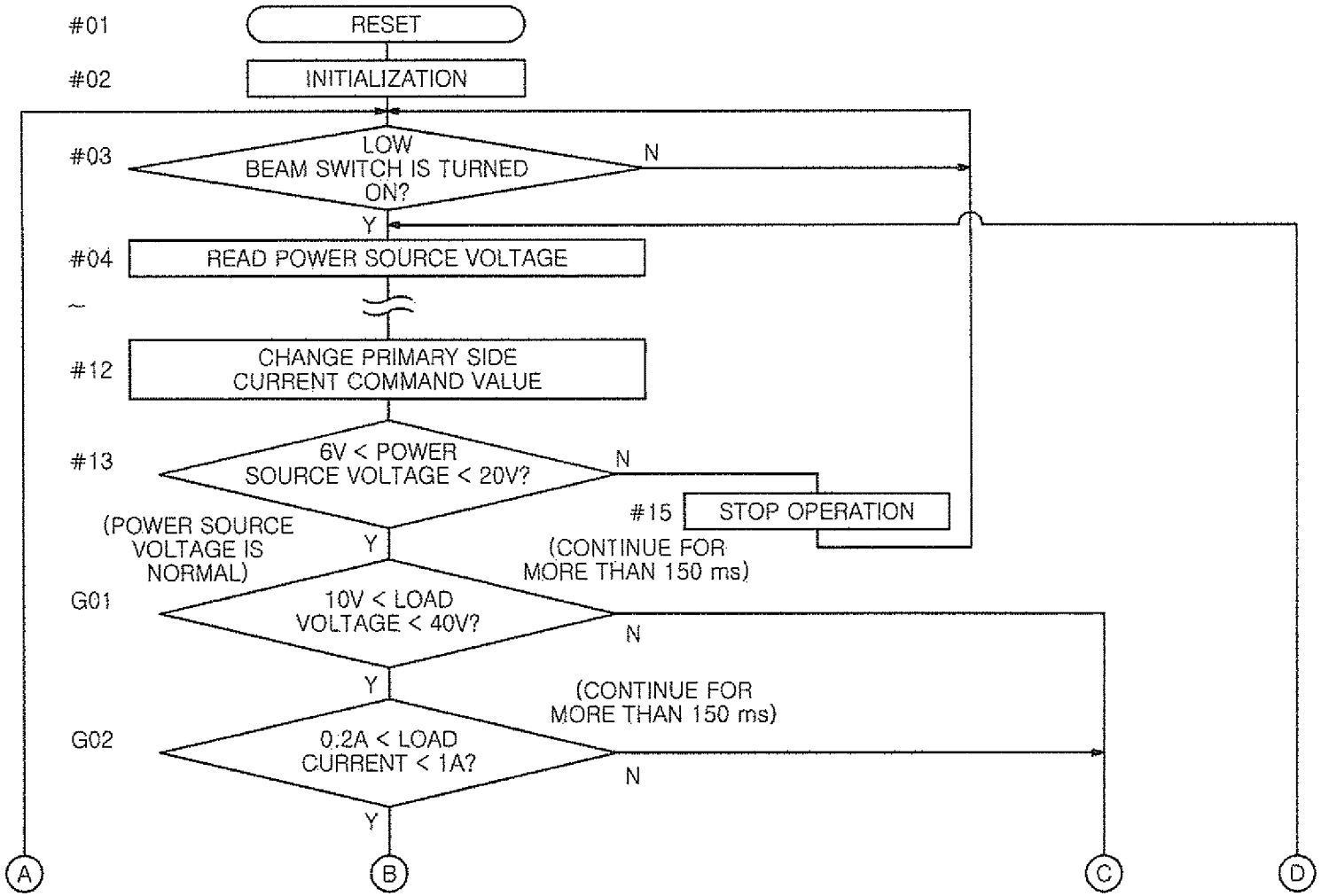
FIGS. 17A and 17B illustrate a flow chart of an operation in accordance with a seventh embodiment of the present invention.
Figure 17B:
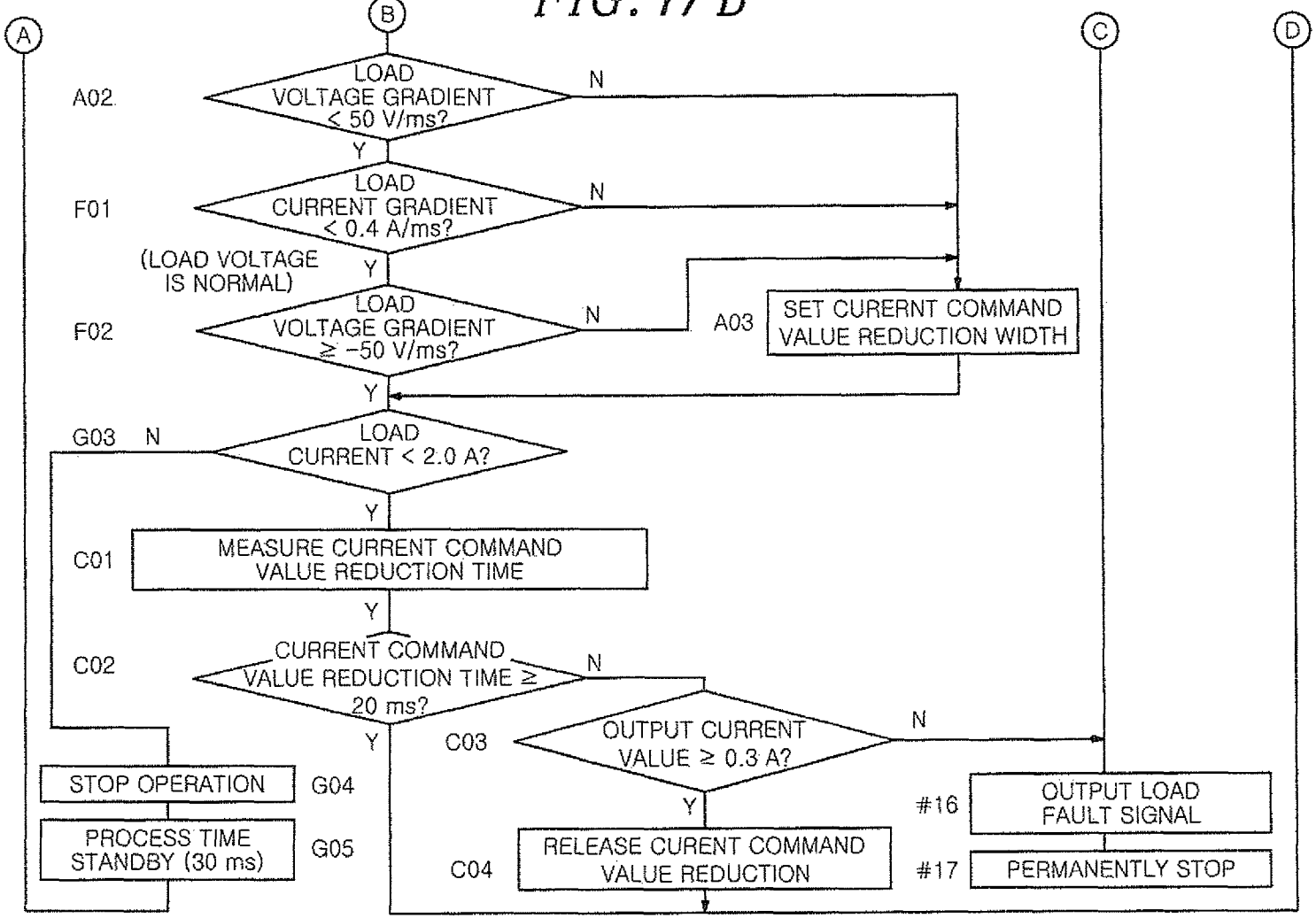

FIGS. 17A and 17B show a control flow of the control unit used in the seventh embodiment of the present invention. The configuration of the lighting device is the same as that of the first embodiment. Further, the same reference numerals are used for the same control flows as those of the third embodiment and the sixth embodiment and a repeated description thereof will be omitted. Although not shown, steps #04 to #12 are the same as those of FIGS. 7A and 7B.

In the sixth embodiment, it is determined whether or not the load voltage is normal in step #14, but in the present embodiment, it is changed to determinations in steps G01 and G02. In step G01, when a fault of the load voltage continues for 150 ms, the process proceeds to the permanent stopping (step #17) via from the load fault signal output (step #16). Further, in step G02, when the fault of the load current (the output current is between 0.2 A and lower than 1.0 A) continues for 150 ms, the process proceeds to the permanent stopping (step #17) via outputting of the load fault signal (step #16).

In addition, step G03 for determining whether or not an output current value is less than a certain current value (e.g., 2.0 A in the present embodiment), which is greater than a normal range of the load, is added, and when the output current value is equal to or higher than the certain current value, the operation is stopped (step G04) as in step #15, and after the standby time process (step G05) is performed, the process proceeds to step #03 for starting constant current control.

Figure 18:
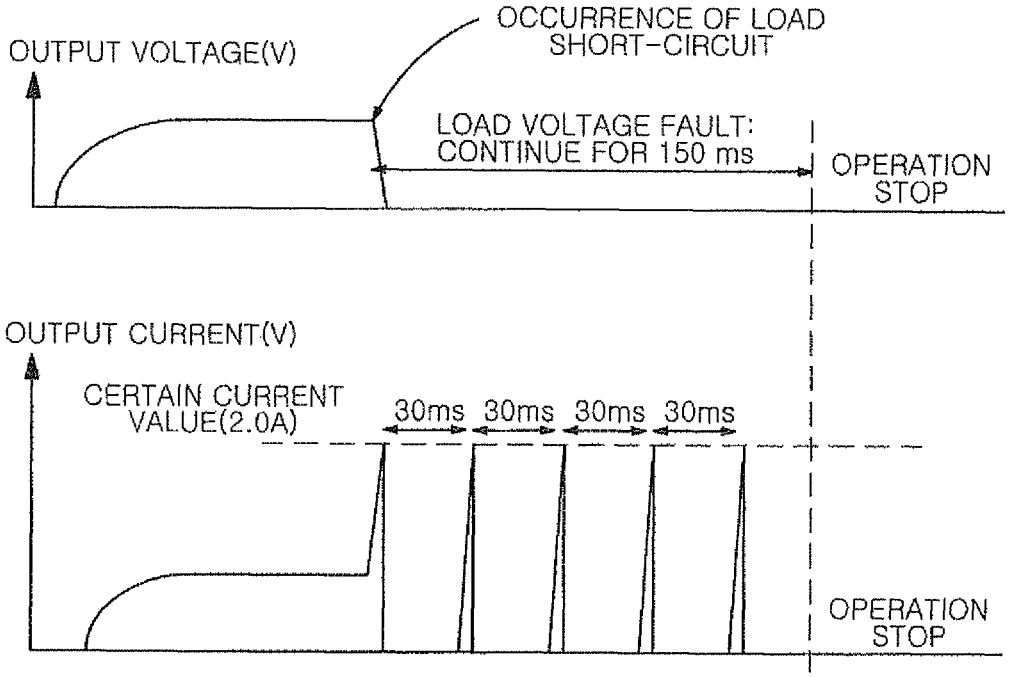
FIG. 18 presents graphs showing operational waveforms in the occurrence of a load short-circuit in the seventh embodiment of the present invention.

FIG. 18 shows a change in the output voltage and output current when the load is rapidly short-circuited in the case of implementing the present embodiment. When the load is short-circuited and a current, which is equal to or greater than the certain current value (0.2 A), flows because an output reduction is delayed, the operation is immediately stopped. Thereafter, the operation is initiated after, e.g., 30 ms. Since, however, the load is still short-circuited, the current is again equal to or higher than the certain current value (2.0 A), and thus, the operation is repeatedly stopped. With the intermittent repetition of the operation initiation and operation stopping, even when a circuit is configured such that the reduction of output current is delayed due to the rapid change in the output current, the operation is stopped to protect the semiconductor light source and the lighting device Further, since the output voltage is not increased due to short-circuit of the load, the load voltage is continuously determined to have a fault (step G01), and when 150 ms has lapsed since the short-circuit of the load, the process proceeds to the permanent stopping (steps #16 and #17), thus stably stopping the operation of the circuit.

In accordance with the present embodiment, even when the load is rapidly changed such that a reduction in the output is delayed (or difficult), the operation is instantly stopped to prevent damage. Further, when permanent stopping is instantaneously performed, malfunction due to influence of noise or the like may occur. Therefore, the fault of the load can be reliably detected through the intermittent operation. Accordingly, in spite of the rapid change in the load such that the reduction in the output is delayed, the semiconductor light source and the lighting device can be protected.

In the present embodiment, when the state in which the load current is 1.0 A or greater continues for more than 150 ms, permanent stopping (step #17) is executed after the load fault signal output (step #16). Within 150 ms, when the load current is equal to or greater than 2.0 A, which is a current value equivalent to double of the rated current value (0.7 A) (in general, the constant current is controlled to be 0.7 A, so the load current may not reach such a current level in a general load change), the semiconductor light source and the lighting device are protected through the operation stopping (step G04) and the standby time process (step G05).

In the present embodiment, when the state in which the load current is 1.0 A or greater continues for more than 150 ms, the operation of the semiconductor light source and the lighting device is stopped, and this is substantially the same as the case where a state in which when the load voltage is 10 V or lower continues for more than 150 ms, the operation is stopped. Thus, obviously, the same control may be realized through any of steps G01 and G02 in the flow.

Eighth Embodiment

Figure 19:
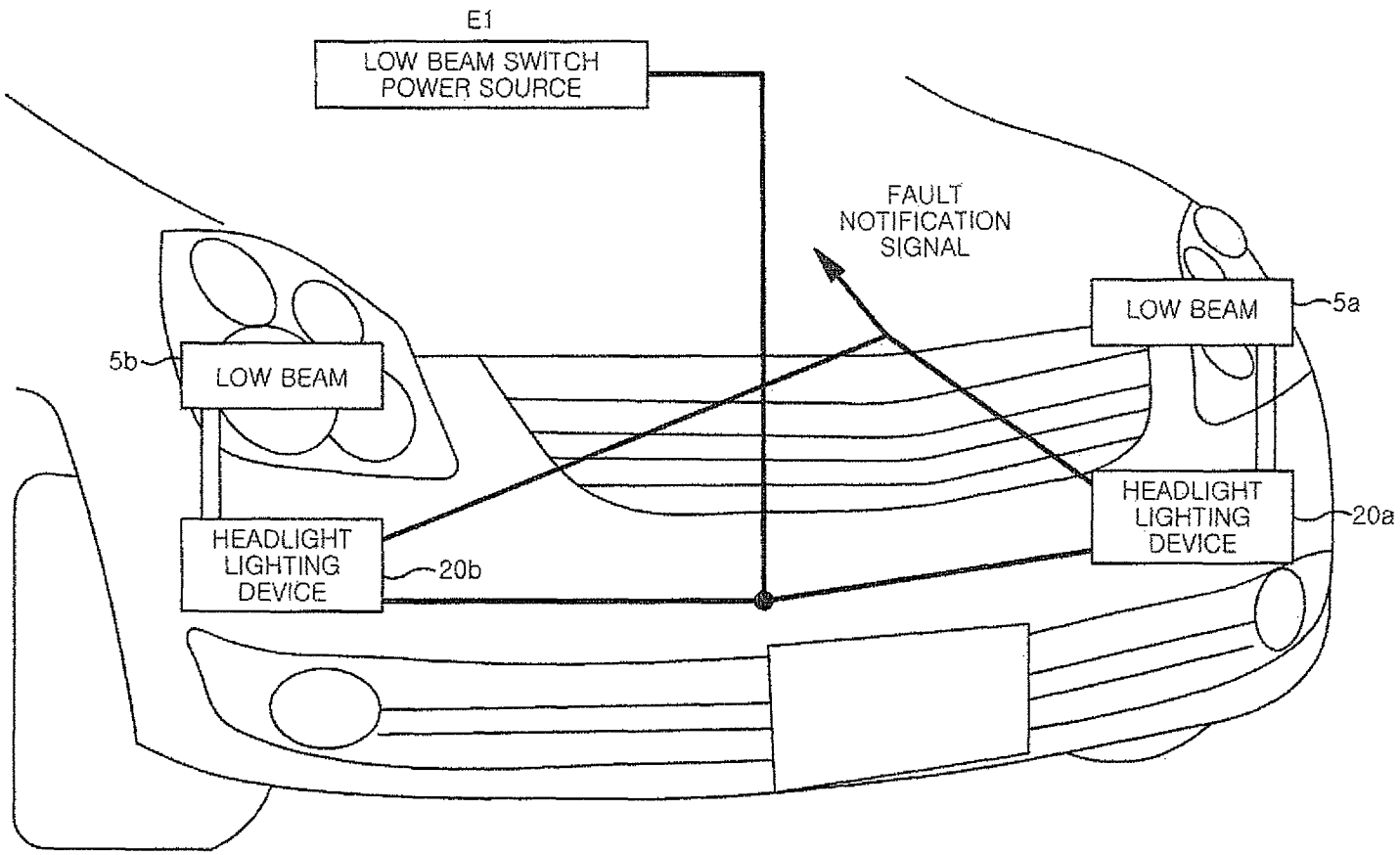
FIG. 19 is a schematic view showing a configuration of a headlight and a vehicle in accordance with an eighth embodiment of the present invention.

FIG. 19 shows a headlight including the lighting device and a vehicle including the headlight in accordance with the present invention. Reference numerals 5*a* and 5*b* denote light source loads used in a headlight (low beam) of the vehicle, and reference numerals 20*a* and 20*b* denote lighting devices thereof. The LOW beam switch power source E1 is configured as a series circuit with a vehicle battery and a headlight switch, and when the headlight switch is turned on, a DC power is supplied to 20*a* and 20*b* to light the light source loads 5*a* and 5*b*. When the load has a fault, a fault notification signal is outputted from the lighting devices 20*a* and 20*b*. By mounting the lighting device or the headlight in accordance with the present invention, a vehicle having the effects as described above in the respective embodiments can be realized.

Ninth Embodiment

Figure 20:
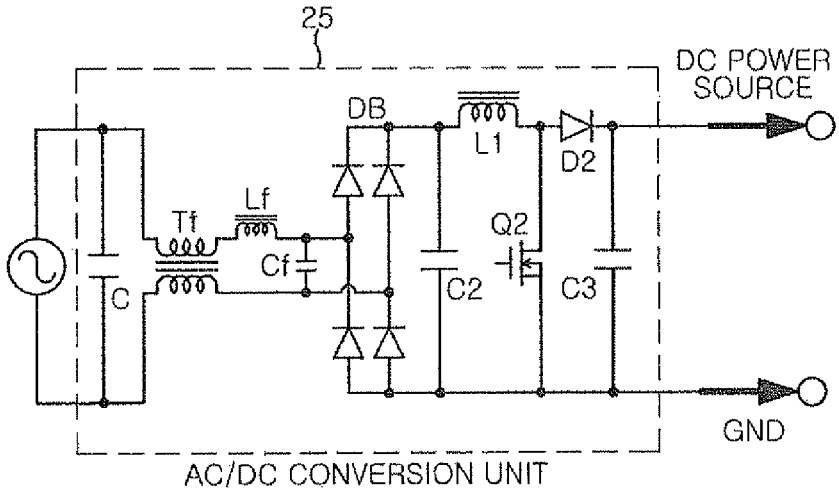
FIG. 20 is a circuit diagram of an AC/DC conversion circuit used in a lighting apparatus in accordance with a ninth embodiment of the present invention.

FIG. 20 shows an example of an AC/DC conversion unit 25 for connecting the lighting device to an AC power source. An input capacitor C, a filter coil Tf, an inductor Lf, and a capacitor Cf are included in a low pass filter used for removing switching noise. AC power Vs is full-wave rectified by a diode bridge DB, and a ripple voltage obtained from a capacitor C2 is smoothed by a step-up chopper circuit including an inductor L1, a switching device Q2, a diode D2, and a smoothing capacitor C3 to obtain a DC power. Accordingly, a lighting device that can be connected to the AC power source can be realized.

Figure 21:
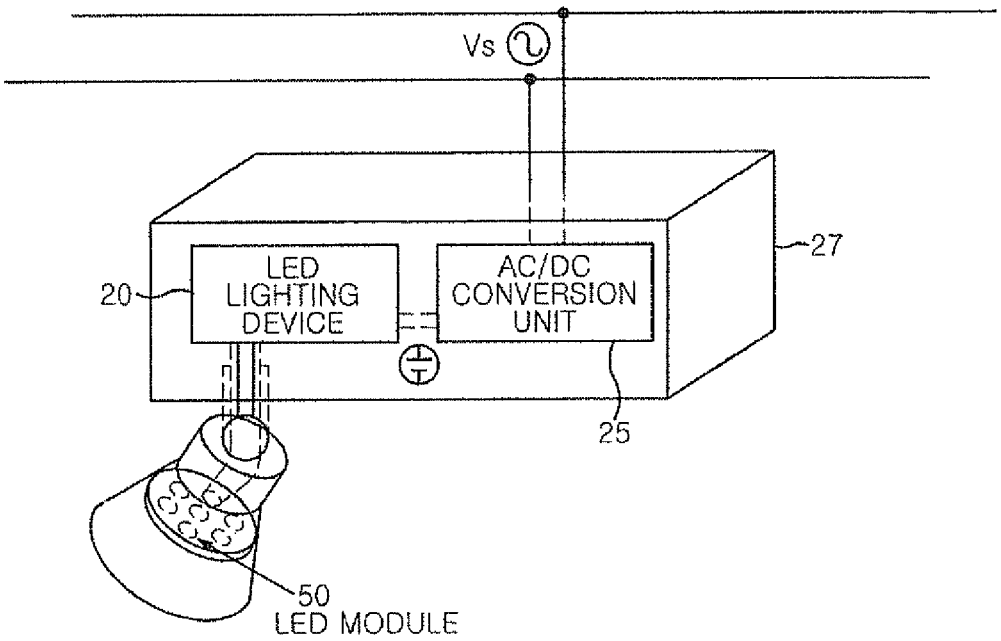
FIG. 21 is a schematic view showing a configuration of a lighting apparatus in accordance with the ninth embodiment of the present invention.
Figure 22:
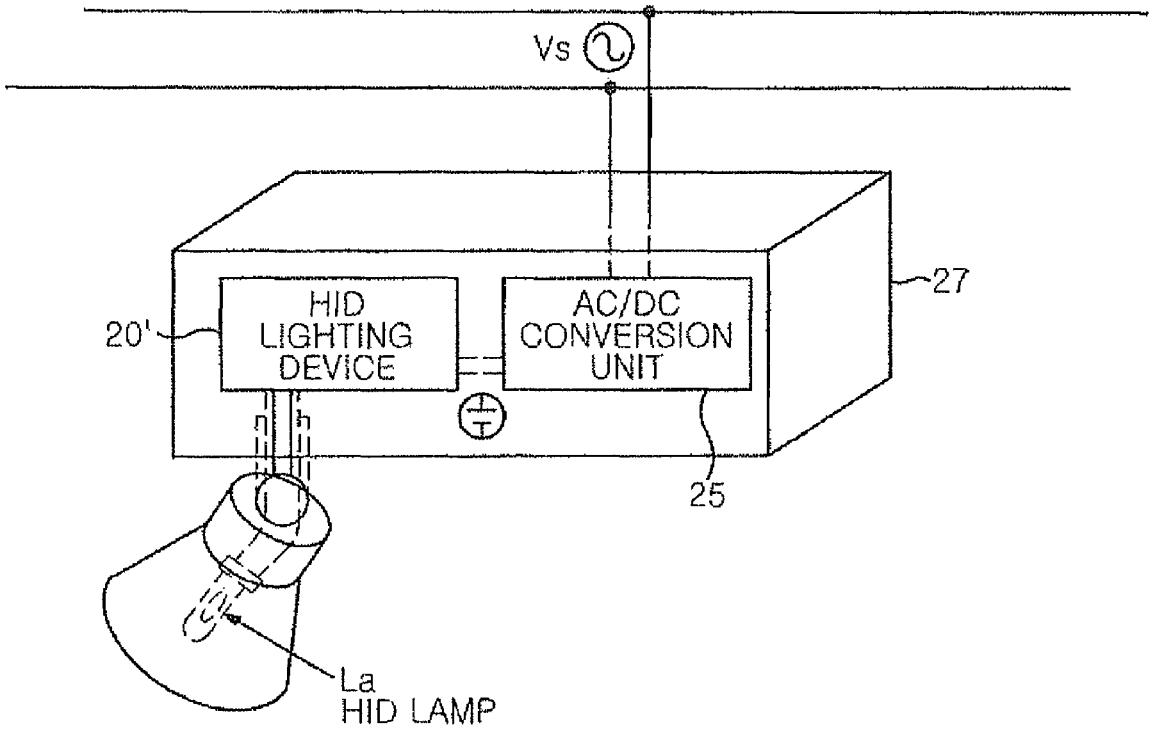
FIG. 22 is a schematic view showing a configuration of another lighting apparatus in accordance with the ninth embodiment of the present invention.

In FIGS. 21 and 22 respectively present an LED lighting apparatus and an HID lighting apparatus which include the foregoing AC/DC conversion unit 25 to be connected to the AC power source. An LED module 50 in FIG. 21 is a module in which multiple LEDs are connected in series or in parallel. A main body 27 includes the AC/DC conversion unit 25, an LED lighting device 20, or an HID lighting device 20'. A stable lighting apparatus can be realized by using the lighting device in accordance with the present invention without damaging a light source and a lighting device.

In the present embodiment, the AC/DC conversion unit is configured as a step-up chopper, but it may be configured by a diode bridge and a capacitor. Further, the DC/DC converter 1 of the lighting device is described by using a flyback circuit, but any circuit configuration such as a step-up chopper, a step-down chopper, a step-up/step-down chopper such as an auto-transformer, a cuke circuit, or the like may also be preferably used.

While the invention has been shown and described with respect to the embodiments, the present invention is not limited thereto.

It will be understood by those skilled in the art that various changes and modifications may be made without departing from the scope of the invention as defined in the following claims.

What is claimed is:

1. A lighting device, comprising:

a DC/DC converter for receiving a DC power and converting the DC power into a predetermined output required for a load;

a voltage detection unit for detecting an output voltage or a corresponding value to the output voltage;

a current detection unit for detecting an output current or a corresponding value to the output current; and a control unit configured to control the DC/DC converter based on detection values from the voltage detection unit and/or the current detection unit, wherein after the output is stabilized, the control unit determines that a voltage of the DC input power has been increased or the load has a fault when detecting that an absolute value of a gradient of a change in the output versus time is equal to or greater than a predetermined value, and reduces the output.

2. The lighting device of claim 1, wherein the load is a semiconductor light source, and the control unit controls the DC/DC converter such that the output current becomes a first predetermined current value.

3. The lighting device of claim 1, wherein the control unit reduces the output when a change in the output voltage is equal to or greater than 5 V per 100 μs.

4. The lighting device of claim 1, wherein the control unit reduces the output when the output current is equal to or greater than 0.12 A per 300 μs.

5. The lighting device of claim 2, wherein when a current greater than a second predetermined current value and smaller than a third predetermined current value continues for a predetermined period of time, the control unit controls the DC/DC converter to be stopped, and the control unit reduces the output when a current equal to or greater than the third predetermined current value is detected, the second predetermined current value being greater than the first predetermined current value and less than the third predetermined current value.

6. The lighting device of claim 1, wherein the control unit controls the DC/DC converter in a boundary current mode, and the reduction in the output is changing the mode into a discontinuous current mode while maintaining an ON period of a switching device of the DC/DC converter.

7. The lighting device of claim 1, wherein the reduction in the output is stopping the DC/DC converter.

8. The lighting device of claim 1, wherein the reduction in the output is intermittently operating the DC/DC converter.

9. The lighting device of claim 2, wherein the reduction in the output is changing from controlling the output current to be the first predetermined current value into controlling the output voltage to be a predetermined voltage value.

10. The lighting device of claim 9, wherein the predetermined voltage value is a voltage value before the output is changed.

11. The lighting device of claim 2, wherein when the output current, after a predetermined period of time since the reduction of the output, is equal to or greater than a predetermined determination threshold value, the control unit returns the output current to become the first predetermined current value.

12. The lighting device of claim 11, wherein the predetermined determination threshold value is set to be smaller than the first predetermined current value.

13. The lighting device of claim 11, wherein the predetermined period of time is less than 20 ms.

14. A headlight lighting device comprising the lighting device of claim 1, and lighting a headlight of a vehicle.

15. A headlight comprising the lighting device of claim 1.

16. A vehicle comprising the lighting device of claim 1.

* * * * *